US007563555B2

(12) United States Patent
Watanabe et al.

(10) Patent No.: US 7,563,555 B2
(45) **Date of Patent: *Jul. 21, 2009**

(54) TONER, DEVELOPER INCLUDING THE TONER, AND METHOD FOR FIXING TONER IMAGE

(75) Inventors: Yohichiroh Watanabe, Fuji (JP); Masanori Suzuki, Suntoh-gun (JP); Tsunemi Sugiyama, Numazu (JP); Hiroshi Yamashita, Numazu (JP); Takuya Saito, Numazu (JP); Naohiro Watanabe, Suntoh-gun (JP); Masami Tomita, Numazu (JP); Shigeru Emoto, Numazu (JP); Shinichiro Yagi, Numazu (JP); Hiroshi Yamada, Numazu (JP); Toshiki Nanya, Mishima (JP); Tadao Takigawa, Shinshiro (JP)

(73) Assignee: Ricoh Company Limited, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/475,165

(22) Filed: Jun. 27, 2006

(65) Prior Publication Data

US 2006/0240349 A1 Oct. 26, 2006

Related U.S. Application Data

(62) Division of application No. 10/670,320, filed on Sep. 26, 2003.

(30) Foreign Application Priority Data

Sep. 26, 2002 (JP) ..... 2002-281900
Nov. 18, 2002 (JP) ..... 2002-333251
Dec. 17, 2002 (JP) ..... 2002-365782

(51) Int. Cl.
*G03G 9/087* (2006.01)

(52) U.S. Cl. ..... 430/137.19; 430/108.1; 430/108.4; 430/109.4; 430/110.3

(58) Field of Classification Search ..... 430/108.1, 430/108.4, 109.4, 110.3, 137.15, 137.11, 430/137.19, 137.17, 124, 137.16
See application file for complete search history.

(56) References Cited

U.S. PATENT DOCUMENTS

| | | | | |
|---|---|---|---|---|
| 4,980,257 | A | 12/1990 | Anno et al. | |
| 5,066,558 | A | 11/1991 | Hikake et al. | |
| 6,106,986 | A | 8/2000 | Shirai et al. | |
| 6,416,917 | B1 | 7/2002 | Nakanishi et al. | 430/109.2 |
| 6,503,676 | B2 | 1/2003 | Yamashita et al. | 430/108.3 |
| 6,593,048 | B2 | 7/2003 | Sasaki et al. | 430/106.1 |
| 7,005,480 | B2 | 2/2006 | Kinosho et al. | |
| 2002/0037467 | A1 * | 3/2002 | Watanabe et al. | 430/110.1 |
| 2002/0081510 | A1 * | 6/2002 | Sugiyama et al. | 430/108.1 |
| 2003/0138717 | A1 | 7/2003 | Yagi et al. | 430/110.4 |
| 2003/0152859 | A1 | 8/2003 | Emoto et al. | 430/109.4 |
| 2003/0180644 | A1 | 9/2003 | Nanya et al. | 430/108.22 |
| 2004/0234882 | A1 | 11/2004 | Matsui et al. | 430/110.3 |
| 2004/0259013 | A1 | 12/2004 | Ohtani et al. | 430/109.4 |
| 2004/0265721 | A1 | 12/2004 | Matsuoka et al. | 430/109.4 |
| 2005/0003288 | A1 | 1/2005 | Sugiyama et al. | 430/108.1 |
| 2005/0026064 | A1 | 2/2005 | Sugiura et al. | 430/109.4 |

FOREIGN PATENT DOCUMENTS

| | | |
|---|---|---|
| JP | 63-131149 | 6/1988 |
| JP | 05-061242 | 3/1993 |
| JP | 05-181301 | 7/1993 |
| JP | 06-342224 | 12/1994 |
| JP | 08-220808 | 8/1996 |
| JP | 08-254853 | 10/1996 |
| JP | 09-258480 | 10/1997 |
| JP | 11-149180 | 6/1999 |
| JP | 2001-175025 | 6/2001 |
| WO | WO 01/60893 A1 | 8/2001 |

OTHER PUBLICATIONS

Whelan, T., consultant, *Polymer Technology Dictionary*, Chapman & Hall, NY (1994), p. 444.*
Patent Abstracts of Japan, English Abstract of JP 05-061242.
Patent Abstracts of Japan, English Abstract of JP 05-181301.
Patent Abstracts of Japan, English Abstract of JP 06-342224.
Patent Abstracts of Japan, English Abstract of JP 08-254853.
Patent Abstracts of Japan, English Abstract of JP 08-220808.
Patent Abstracts of Japan, English Abstract of JP 09-258480.
Patent Abstracts of Japan, English Abstract of JP 11-149180.
Patent Abstracts of Japan, English Abstract of JP 2001-175025.
Patent Abstracts of Japan, English Abstract of JP 63-131149.
esp@cenet—English Abstract of WO 01/60893 A1.

(Continued)

*Primary Examiner*—Janis L Dote
(74) *Attorney, Agent, or Firm*—Oblon, Spivak, McClelland, Maier & Neustadt, P.C.

(57) ABSTRACT

A toner composition including toner particles including a binder resin including a modified polyester resin, and a second resin having a weight average molecular weight of from 2,000 to 10,000; a colorant; a release agent; and a particulate material which is present at least a surface portion of the toner particles while embedded into the surface portion, wherein the binder resin has a glass transition temperature not lower than 35° C. and lower than 55° C., and wherein the particulate material has an average particle diameter of from 0.002 to 0.2 times that of the toner particles. A developer including the toner composition and a carrier having a layer thereon which includes at least an acrylic resin and a silicone resin, and a method for fixing an image of the toner composition are also provided.

10 Claims, 3 Drawing Sheets

OTHER PUBLICATIONS

U.S. Appl. No. 11/375,050, filed Mar. 15, 2006, Ohki, et al.
U.S. Appl. No. 11/529,370, filed Sep. 29, 2006, Emoto, et al.
U.S. Appl. No. 11/738,149, filed Apr. 20, 2007, Iwamoto, et al.
U.S. Appl. No. 11/755,484, filed May 30, 2007, Watanabe, et al.
U.S. Appl. No. 11/755,517, filed May 30, 2007, Iwamoto, et al.
U.S. Appl. No. 11/752,343, filed May 23, 2007, Nagatomo, et al.
U.S. Appl. No. 11/851,475, filed Sep. 7, 2007, Watanabe, et al.
U.S. Appl. No. 11/852,778, filed Sep. 10, 2007, Nagatomo, et al.
U.S. Appl. No. 11/857,791, filed Sep. 19, 2007, Kojima, et al.
U.S. Appl. No. 11/857,999, filed Sep. 19, 2007, Yamashita, et al.
U.S. Appl. No. 11/943,929, filed Nov. 21, 2007, Nakayama, et al.
U.S. Appl. No. 11/943,972, filed Nov. 1, 2007, Nakayama, et al.
U.S. Appl. No. 12/013,108, filed Jan. 11, 2008, Yagi, et al.
U.S. Appl. No. 12/040,451, filed Feb. 29, 2008, Saitoh, et al.
U.S. Appl. No. 12/048,741, filed Mar. 14, 2008, Moriya, et al.
U.S. Appl. No. 12/049,686, filed Mar. 17, 2008, Kotsugai, et al.
U.S. Appl. No. 12/050,502, filed Mar. 18, 2008, Yamada, et al.
U.S. Appl. No. 12/046,011, filed Mar. 11, 2008, Nagatomo, et al.
Patent Abstracts of Japan, English Abstract of JP 05-061242, Copyright 1998, 2003.
Patent Abstracts of Japan, English Abstract of JP 05-161301, Copyright 1998, 2003.
Patent Abstracts of Japan, English Abstract of JP 06-342224, Copyright 1998, 2003.
Patent Abstracts of Japan, English Abstract of JP 08-254853, Copyright 1998, 2003.
Patent Abstracts of Japan, English Abstract of JP 08-220808, Copyright 1998, 2003.
Patent Abstracts of Japan, English Abstract of JP 09-258480, Copyright 1998, 2003.
Patent Abstracts of Japan, English Abstract of JP 11-149180, Copyright 1998, 2003.
Patent Abstracts of Japan, English Abstract of JP 2001-175025, Copyright 1998, 2003.
Patent Abstracts of Japan, English Abstract of JP 63-131149, Copyright 1998, 2003.
esp@cenet—English Abstract of WO 01/60893 A1, published Aug. 2001.
U.S. Appl. No. 12/209,583, filed Sep. 12, 2008, Seshita, et al.

* cited by examiner

TONER, DEVELOPER INCLUDING THE TONER, AND METHOD FOR FIXING TONER IMAGE

BACKGROUND OF THE INVENTION

1. Field of the Invention

The present invention relates to a toner for developing an electrostatic latent image formed by an image forming method such as electrophotography, electrostatic recording and electrostatic printing. In addition, the present invention also relates to a developer including a toner, and a method for fixing a toner image.

2. Discussion of the Background

Electrophotographic image forming methods are widely used for copiers, facsimile machines, laser printers, etc. The electrophotographic image forming methods typically include the following processes:

(1) charging a photoreceptor (charging process);
(2) irradiating the photoreceptor with imagewise light to form an electrostatic latent image thereon (imagewise light irradiation process);
(3) developing the electrostatic latent image with a developer including a toner to form a toner image on the photoreceptor (developing process);
(4) transferring the toner image onto a receiving material such as paper optionally via an intermediate transfer medium (transfer process)
(5) fixing the toner image on the receiving material, for example, upon application of heat and pressure thereto (fixing process); and
(6) cleaning the surface of the photoreceptor (cleaning process).

In order to produce high quality image, it is important to faithfully develop an electrostatic latent image with a developer (i.e., a toner), and requisites for the toner are preservation property (blocking resistance), feeding ability, developing ability, transferring ability, charging ability, fixing ability, etc.

Methods for producing toners are broadly classified into two methods, pulverization methods and suspension polymerization methods.

Procedures of the pulverization methods are as follows:

(1) toner constituents such as thermoplastic resins, colorants, charge controlling agents and other additives are uniformly mixed and kneaded upon application of heat thereto;
(2) the kneaded mixture is cooled and then pulverized to prepare a colored powder; and
(3) the colored powder is classified to prepare toner particles.

Toners prepared by pulverization methods have a certain degree of properties. However, there are narrow options for selection of materials in the pulverization methods. For example, the kneaded mixture has to be pulverized by a general pulverizer and classified by a general classifier, i.e., the kneaded mixture has to be so brittle as to be easily pulverized. Therefore, when kneaded mixture is pulverized, the resultant colored powder has a broad particle diameter distribution.

In this case, in order to produce toner images having good resolution and gradation, fine particles having a particle diameter not greater than 5 μm and coarse particles having a particle diameter not less than 20 μm have to be removed in the classification process, resulting in occurrence of a problem in that the yield seriously decreases in the pulverization methods. In addition, it is difficult to uniformly disperse a colorant and a charge controlling agent in a thermoplastic resin. If such agents are non-uniformly charged in a binder resin, the fluidity, developing ability, and durability of the resultant toner, and the image qualities of the toner images deteriorate.

Recently, in order to settle the problems of the pulverization methods, polymerization methods have been proposed and practically performed. The technique for producing a toner using a polymerization method is well known. For example, suspension polymerization methods are used for preparing a toner. However, the toner prepared by a suspension polymerization method has a drawback of having a poor cleaning property because of having a spherical form.

When images having a low image area proportion are produced, the amount of toner particles remaining on a photoreceptor is small, and therefore the cleaning problem does not occur generally. However, when images, such as pictures, having a high image area proportion are produced or a large amount of toner particles accidentally remains on a photoreceptor (due to paper jamming, for example), a problem in that the resultant images have a background fouling occurs.

In addition, toner particles remaining on a photoreceptor contaminate the charging roller used for charging the photoreceptor, and thereby the charging ability of the charging roller is deteriorated.

In attempting to solve such problems, a technique in which resin particles prepared by an emulsion method are associated with each other to prepare a toner having an irregular form is proposed in Japanese patent No. 2,537,503. However, toner particles prepared by an emulsion method include a large amount of emulsifier thereon and therein even when the toner particles are washed. Therefore, the resultant toner has a poor environmental stability, and a broad charge quantity distribution, resulting in occurrence of background fouling in the resultant images. In addition, the surfactant remaining on the toner particles contaminates the photoreceptor, charging roller and developing roller used, and thereby the members lose their original functions.

In addition, the method in which a toner is prepared by associating resin particles prepared by an emulsion polymerization method has the following drawbacks:

(1) fine particles of a release agent, which are typically included in the toner to improve the offset resistance of the toner, are included inside of the toner particles, and thereby good offset resistance cannot be imparted to the toner;
(2) since resin particles, release agent particles and colorant particles are randomly adhered to each other to constitute toner particles, the resultant toner particles have variations in formula (i.e., variations in contents of the toner constituents) and molecular weight of the resin particles included therein, i.e., the toner particles have different surface properties, and thereby images having good image qualities cannot be stably produced; and
(3) in a low temperature fixing device, images of the resultant toner cannot be fixed at a relatively low fixing temperature because resin particles are mainly present on the surface of the toner particles.

When toner images are fixed while brought into contact with a heat roller, the toner has to have good releasability against the heat roller (i.e., the toner has to have good offset resistance). By including a release agent on the surface of toner particles, the offset resistance of the toner particles can be improved.

Published unexamined Japanese patent applications Nos. (hereinafter JOPs) 2000-292973 and 2000-292978 disclose that resin particles are not only included in the toner particles but also are unevenly present on the surface of the toner particles, to improve the offset resistance of the toner. However, the minimum fixable temperature of the toner increases, i.e., the toner has poor low temperature fixability or poor energy-saving fixability.

In attempting to avoid the offset problem, methods in which a release oil such as silicone oils is applied to the surface of a fixing roller have been typically used. The methods are useful for preventing occurrence of the offset problem, but it is necessary to provide an applicator applying such a release oil, resulting in jumboization of the fixing device and increase in costs of the fixing device.

Therefore, in the case of a monochrome toner, a technique in which the viscoelasticity of the toner is increased, for example, by controlling the molecular weight distribution of the resin included in the toner is used for preventing internal fracture of the toner melted by a heat roller, while adding a release agent such as waxes to the toner to improve the release property of the toner. Thus, fixing methods which use the technique and in which no oil or a small amount of oil is applied to a fixing roller are typically used now.

Recently, a strong need exists for energy-saving image forming apparatus such as copiers and printers. Therefore a need exists for a toner having a low temperature fixability. In order to improve the low temperature fixability of a toner is improved, the viscoelasticity of the toner has to be decreased when the toner is melted, resulting in occurrence of the offset problem. It is effective to decrease the glass transition temperature (Tg) of the binder resin of a toner when improving the low temperature fixability of the toner. In this case, the preservability of the toner deteriorates.

On the other hand, when full color images are formed, yellow, magenta and cyan toners, optionally together with a black toner, are typically used. In order to produce full color images having good color reproducibility, the surface of the toner images has to be smoothed to some extent to decrease light scattering and therefore the viscoelasticity of the toners has to be decreased when the toners are melted. In this case, the color toners tend to cause the offset problem. In addition, when a release agent is included in color toners, the adhesion of the toner particles to each other is increased, and thereby the transferability of the toners is deteriorated. Therefore, it is difficult to use a fixing method for fixing color images, in which no oil or a small amount of oil is applied to a fixing roller.

Under such circumstances, the following toners have been proposed:

(1) a toner prepared by covering mother toner particles having a flow starting temperature not higher than 110° C. with small particles while embedding the small particles into the mother toner particles (Japanese patent No. 2,750,853);

(2) a toner prepared by covering a styrene-acrylic core material having a glass transition temperature of from 50 to 70° C. with a styrene based shell material having a higher molecular weight and a higher glass transition temperature (JOP 05-181301);

(3) a toner prepared by fixing a particulate resin on mother toner particles using a mechanical impacting method to reform the surface of the mother toner particles (JOP 06-342224);

(4) a toner prepared by microencapsulating a core material such as saturated fatty acids and saturated alcohols, which has a melting point of from 40 to 100° C. and which is suspended in water, with a particulate resin (JOP 08-254853);

(5) a toner prepared by overlaying a thermally stable layer and a thermoplastic resin layer having a Tg not lower than 65° C. on the surface of a particulate resin having a low viscosity (JOP 09-258480);

(6) a toner prepared by adhering a particulate resin having a Tg of from 60 to 110° C. on the surface of toner particles including a resin having a Tg of from 25 to 55° C. (JOP 2001-175025);

(7) a toner including a linear polyester resin having a softening point of from 90 to 120° C. and a carnauba wax (JOP 08-220808);

(8) a polymerized toner including a wax therein (JOP05-61242) and (9) a toner prepared by extending or crosslinking an isocyanate-group-containing prepolymer in an aqueous medium using an amine (JOP 11-149180).

However, these toners do not necessarily have a good combination of low temperature fixability, offset resistance, preservability and transferability. Namely, the toners having a shell/core structure in which the shell is a uniform layer have poor low temperature fixability. The toner having a particulate shell has a low viscoelasticity when the toner is melted, and thereby the offset resistance is not satisfactory because the toner does not include a release agent. In general, wax tends to be mainly present on the surface of pulverized toners because the kneaded mixture tends to be fractured at interfaces between the wax and a resin. Therefore the pulverized toners tend to have poor transferability although having good offset resistance. In contrast, polymerized toners in which toner particles are prepared in an aqueous medium have poor offset resistance although having good transferability, because wax tends to be present inside of toner particles.

Because of these reasons, a need exists for a toner having a good combination of low temperature fixability, offset resistance, preservability and transferability even when a fixing method in which no oil or a small amount of oil is applied to a fixing roller is used.

SUMMARY OF THE INVENTION

Accordingly, an object of the present invention is to provide a toner having a good combination of low temperature fixability, offset resistance, preservability and transferability even when a fixing method in which no oil or a small amount of oil is applied to a fixing roller is used.

Another object of the present invention is to provide a developer which can produce high quality images even when a fixing method in which no oil or a small amount of oil is applied to a fixing roller is used.

Yet another object of the present invention is to provide a fixing method which can produce high quality images even when no oil or a small amount of oil is applied to a fixing roller.

Briefly these objects and other objects of the present invention as hereinafter will become more readily apparent can be attained by a toner composition including:

toner particles including:

a binder resin including:

a modified polyester resin; and a second resin having a weight average molecular weight of from 2,000 to 10,000, a colorant;

a release agent; and a particulate material which is present at least a surface portion of the toner particles while embedded into the surface portion, wherein the binder resin has a glass transition temperature not lower than 35° C. and lower than 55° C., and wherein the particulate material has an average particle diameter of from 0.002 to 0.2 times that of the toner particles.

The second resin is preferably an unmodified polyester resin. The weight ratio (i/ii) of the modified polyester resin (i) to the unmodified polyester resin (ii) is generally from 5/95 to 60/40, preferably from 5/95 to 30/70, more preferably from 5/95 to 25/75, even more preferably from 8/92 to 25/75, even more preferably from 10/90 to 25/75, even more preferably 12/88 to 25/75 and most preferably from 12/88 to 22/78. The unmodified polyester resin preferably has an acid value of from 0.5 to 40 mgKOH/g.

The modified and unmodified polyester resins preferably have a number average molecular weight of from 2,000 to 15,000 and a molecular weight distribution such that a peak is observed in a range of from 1,000 to 30,000 and components having a molecular weight not less than 30,000 are included in an amount not less than 1% by weight. In addition, components having a molecular weight not greater than 1,000 are preferably included in the polyester resins in an amount of from 0.1 to 5.0% by weight.

The particulate material is preferably a particulate resin which has a volume average particle diameter of from 50 to 500 nm and which has a glass transition temperature of from 40 to 100° C. and more preferably from 55 to 100° C. and a weight average molecular weight of from 9,000 to 200,000; and/or an inorganic particulate material. The particulate resin is preferably a resin having units obtained from styrene and methacrylic acid which satisfies the following relationship:

$$10 \leqq a \leqq 51,\ 15 \leqq b \leqq 51,\ \text{and}\ 0.4 \leqq a/b \leqq 2.5,$$

wherein a and b respectively represent weight ratios of styrene and methacrylic acid based on total monomers constituting the particulate resin.

The particulate resin is preferably a resin selected from the group consisting of vinyl resins, urethane resins, epoxy resins and polyester resins.

The particulate resin is preferably present in the toner in an amount of from 0.5 to 5.0% by weight.

The particulate resin embedded into the surface of the toner particles is preferably crosslinked.

The binder resin preferably includes components insoluble in tetrahydrofuran in an amount of from 2 to 20% by weight.

The release agent is preferably a wax.

The toner preferably has a flow starting temperature of from 80 to 170° C.

The toner preferably has a volume average particle diameter (Dv) of from 3 to 7 μm. In addition, the ratio (Dv/Dn) of the volume average particle diameter (Dv) to the number average particle diameter are preferably not greater than 1.25.

The toner particles preferably have a circularity of from 0.975 to 0.900.

The toner particles preferably have a spindle form, and the ratio (r2/r1) of a minor axis particle diameter (r2) of the toner particles to a major axis particle diameter (r1) of the toner particles is from 0.5 to 0.8, and a ratio (r3/r2) of a thickness (r3) of the toner particles to the minor axis particle diameter (r2) is from 0.7 to 1.0.

As another aspect of the present invention, a method for manufacturing a toner is provided which includes the steps of:

dissolving or dispersing a composition, which includes at least a modified polyester resin capable of reacting with an active hydrogen and a second resin having a weight average molecular weight of from 2,000 to 10,000, a colorant, a release agent, and a compound having an active hydrogen, in an organic solvent to prepare an oil phase liquid;

dispersing the oil phase liquid in an aqueous medium including a particulate material while subjecting the modified polyester resin to a polymerization reaction to prepare a modified polyester resin and to prepare a dispersion;

removing at least the organic solvent in the dispersion to prepare toner particles;

washing the toner particles; and drying the toner particles.

As yet another aspect of the present invention, a developer is provided which includes the toner mentioned above and a carrier which is coated with an acrylic resin and/or a silicone resin.

As a further aspect of the present invention, a fixing method is provided which includes:

passing an image bearing material bearing a toner image thereon through a nip between a fixing belt and a pressure member while applying heat to the toner image to fix the toner image, wherein the fixing belt has a U form at the nip, wherein the toner is the toner of the present invention.

Another aspect of the present invention is a toner container containing the toner composition described above.

In yet another embodiment, the invention provides a method for manufacturing a toner comprising toner particles, comprising:

dissolving or dispersing a toner composition, comprising (i) at least a polyester prepolymer (A) having an isocyanate group, and being capable of reacting with an active hydrogen;

(ii) an amine as a compound having an active hydrogen, (iii) a second resin having a weight average molecular weight of from 2,000 to 10,000, (iv) a colorant, and (v) a release agent, in an organic solvent, to obtain an oil phase liquid;

dispersing the oil phase liquid in an aqueous medium comprising a particulate material while subjecting the polyester prepolymer (A) to an addition polymerization reaction using said compound having said active hydrogen as a cross-linking agent, extending agent or both, to prepare a urea-modified polyester resin and to prepare a dispersion;

removing at least the organic solvent from the dispersion to prepare the toner particles comprising a binder resin which comprises said urea-modified polyester resin and said second resin having a weight average molecular weight of from 2,000 to 10,000;

washing the toner particles; and drying the toner particles;

wherein said particulate material comprises a particulate resin which is crosslinked;

wherein said binder resin has a glass transition temperature of from 35° C. to below 55° C.;

wherein the particulate material is embedded into the surface of the toner particles;

wherein the particulate material has an average particle diameter of from 0.002 to 0.2 times that of the toner particles.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The toner of the present invention includes at least a binder resin, a colorant and a release agent, and is characterized as follows:

(1) the toner of the present invention can be prepared by dissolving a composition including at least a modified polyester resin in an organic solvent to prepare an oil phase liquid; dispersing the oil phase liquid in an aqueous medium including a particulate material such as particulate resins and/or inorganic particulate materials while subjecting the polyester resin to a reaction such as addition polymerization using a crosslinking agent and/or an extending agent to prepare particles; removing the solvents to obtain toner particles; and washing the toner particles to prepare dry toner particles; and (2) the binder resin in the toner of the present invention has a glass transition temperature lower than those of binder resins for use in normal toners, and the particulate material are present on the surface of the toner particles (while embedded into the surface).

Figure 1B:
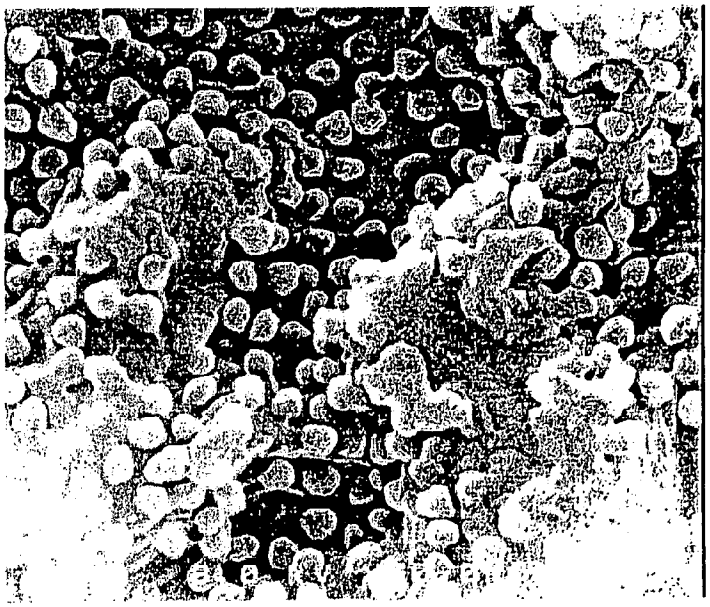
FIGS. 1A and 1B are photographs showing particles of the toner of the present invention observed with a scanning electron microscope.
Figure 1A:
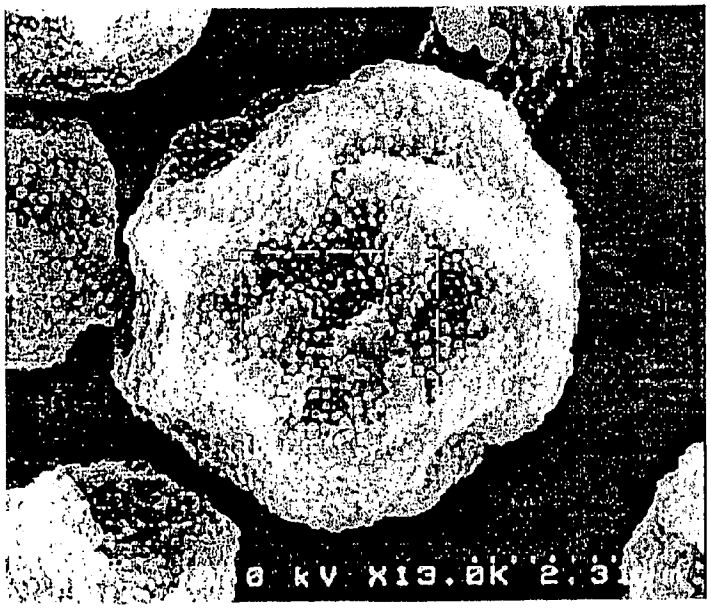

The typical state of the particulate material present on the surface of the toner of the present invention is illustrated in FIGS. 1A and 1B. As can be understood from FIGS. 1A and 1B which is an enlarged view of the portion of a toner particle, which is the squared portion in FIG. 1A, the particulate material is present on the surface portion of the toner particles while substantially separated from each other without causing agglomeration. In addition, the particulate material is substantially separated from each other in the depth direction of the toner particles. Namely the particulate material is substantially separated from the other toner constituents such as binder resins therebetween.

Then the toner constituents for use in the toner of the present invention will be explained.

Binder Resin

The binder resin of the toner of the present invention includes a modified polyester resin, and a second binder resin having a relatively low molecular weight as essential components. As the modified polyester resin, urea-modified polyester resins (i.e., polyester resins having a urea bonding) are preferably used.

A urea-modified polyester resin (i) is included in the toner to impart good offset resistance to the resultant toner. Suitable urea-modified polyester resins include reaction products of a polyester prepolymer (A) with an amine (B). As the polyester prepolymer (A), for example, compounds prepared by reacting a polycondensation product of a polyol (1) and a polycarboxylic acid (2), which has a group having an active hydrogen, with a polyisocyanate (3) are used. Suitable groups having an active hydrogen include a hydroxyl group (an alcoholic hydroxyl group and a phenolic hydroxyl group), an amino group, a carboxyl group, a mercapto group, etc. Among these groups, alcoholic hydroxyl groups are preferable.

Suitable polyols (1) include diols (1-1) and polyols (1-2) having three or more hydroxyl groups. Preferably diols (1-1) or mixtures in which a small amount of a polyol (1-2) is added to a diol (1-1) are used.

Specific examples of the diols (1-1) include alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol) alicyclic diols (e.g., 1,4-cyclohexane dimethanol and hydrogenated bisphenol A); bisphenols (e.g., bisphenol A, bisphenol F and bisphenol S); adducts of the alicyclic diols mentioned above with an alkylene oxide (e.g., ethylene oxide, propylene oxide and butylene oxide); adducts of the bisphenols mentioned above with an alkylene oxide (e.g., ethylene oxide, propylene oxide and butylene oxide); etc.

Among these compounds, alkylene glycols having from 2 to 12 carbon atoms and adducts of bisphenols with an alkylene oxide are preferable. More preferably, adducts of bisphenols with an alkylene oxide, or mixtures of an adduct of bisphenols with an alkylene oxide and an alkylene glycol having from 2 to 12 carbon atoms are used.

Specific examples of the polyols (1-2) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide; etc.

Suitable polycarboxylic acids include dicarboxylic acids (2-1) and polycarboxylic acids (2-2) having three or more carboxyl groups. Preferably dicarboxylic acids (2-1) or mixtures in which a small amount of a polycarboxylic acid (2-2) is added to a dicarboxylic acid (2-1) are used.

Specific examples of the dicarboxylic acids (2-1) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (2-2) having three or more hydroxyl groups include aromatic polycarboxylic acids having from 9 to 20 carbon atoms (e.g., trimellitic acid and pyromellitic acid).

As the polycarboxylic acid (2), anhydrides or lower alkyl esters (e.g., methyl esters, ethyl esters or isopropyl esters) of the polycarboxylic acids mentioned above can be used for the reaction with a polyol (1).

Suitable mixing ratio (i.e., an equivalence ratio [OH]/[COOH]) of a polyol (1) to a polycarboxylic acid (2) is from 2/1 to 1/1, preferably from 1.5/1 to 1/1 and more preferably from 1.3/1 to 1.02/1.

Specific examples of the polyisocyanates (3) include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic didicosycantes (e.g., tolylene diisocyanate and diphenylmethane diisocyanate); aromatic aliphatic diisocyanates (e.g., $\alpha, \alpha, \alpha', \alpha'$-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

Suitable mixing ratio (i.e., [NCO]/[OH]) of a polyisocyanate (3) a polyester is from 5/1 to 1/1, preferably from 4/1 to 1.2/1 and more preferably from 2.5/1 to 1.5/1. When the

[NCO]/[OH] ratio is too large, the low temperature fixability of the toner deteriorates. In contrast, when the ratio is too small, the content of the urea group in the modified polyesters decreases and thereby the hot-offset resistance of the toner deteriorates. The content of the constitutional component of a polyisocyanate (3) in the polyester prepolymer (A) having a polyisocyanate group at its end portion is from 0.5 to 40% by weight, preferably from 1 to 30% by weight and more preferably from 2 to 20% by weight. When the content is too low, the hot offset resistance of the toner deteriorates and in addition the heat resistance and low temperature fixability of the toner also deteriorate. In contrast, when the content is too high, the low temperature fixability of the toner deteriorates.

The number of the isocyanate group included in a molecule of the polyester prepolymer (A) is not less than 1, preferably from 1.5 to 3, and more preferably from 1.8 to 2.5. When the number of the isocyanate group is too small, the molecular weight of the resultant urea-modified polyester decreases and thereby the hot offset resistance deteriorate.

Specific examples of the amines (B) include diamines (B1) polyamines (B2) having three or more amino groups, amino alcohols (B3), amino mercaptans (B4), amino acids (B5) and blocked amines (B6) in which the amines (B1-B5) mentioned above are blocked.

Specific examples of the amines (1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc.

Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids include amino propionic acid and amino caproic acid. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc. Among these compounds, diamines (B1) and mixtures in which a diamine is mixed with a small amount of a polyamine (B2).

The molecular weight of the urea-modified polyesters can be controlled using an elongation anticatalyst, if desired. Specific examples of the elongation anticatalyst include monoamines (e.g., diethyle amine, dibutyl amine, butyl amine and lauryl amine), and blocked amines (i.e., ketimine compounds) prepared by blocking the monoamines mentioned above.

The mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2. When the mixing ratio is too low or too high, the molecular weight of the resultant urea-modified polyester decreases, resulting in deterioration of the hot offset resistance of the resultant toner.

The urea-modified polyesters may include an urethane bonding as well as a urea bonding. The molar ratio (urea/urethane) of the urea bonding to the urethane bonding is from 100/0 to 10/90, preferably from 80/20 to 20/80 and more preferably from 60/40 to 30/70. When the content of the urea bonding is too low, the hot offset resistance of the resultant toner deteriorates.

The urea-modified polyesters can be prepared, for example, by a method such as one-shot methods or prepolymer methods. The weight average molecular weight of the urea-modified polyesters is not less than 10,000, preferably from 15,000 to 10,000,000 and more preferably from 20,000 to 1,000,000. When the weight average molecular weight is too low, the hot offset resistance of the resultant toner deteriorates.

The binder resin having a relatively low molecular weight (i.e., the second binder resin) is included in the toner of the present invention to improve the low temperature fixability of the toner, and known resins for use as the binder resin of conventional toners can be used as the second binder resin.

Specific examples of the resins for use as the second binder resin include styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

The second binder resin preferably has a weight average molecular weight of from 2,000 to 10,000 and a glass transition temperature (Tg) of not less than 35° C. and less than 55° C.

Among these resins, polyester resins, epoxy resins, and epoxy polyol resins are preferably used.

It is preferable to use a combination of a urea-modified polyester resin with an unmodified polyester resin as the binder resin. By using a combination of a urea-modified polyester resin with an unmodified polyester resin, the low temperature fixability of the toner can be improved and in addition the toner can produce color images having a high gloss.

Suitable unmodified polyester resins include polycondensation products of a polyol with a polycarboxylic acid. Specific examples of the polyol and polycarboxylic acid are mentioned above for use in the modified polyester resins. In addition, specific examples of the suitable polyol and polycarboxylic acid are also mentioned above.

In addition, as the unmodified polyester resins, polyester resins modified by a bonding (such as urethane bonding) other than a urea bonding, can also be used as well as the unmodified polyester resins mentioned above.

When a combination of a modified polyester resin with an unmodified polyester resin is used as the binder resin, it is preferable that the modified polyester resin at least partially mixes with the unmodified polyester resin to improve the low temperature fixability and hot offset resistance of the toner. Namely, it is preferable that the modified polyester resin has a molecular structure similar to that of the unmodified polyester resin. The mixing ratio (MPE/PE) of a modified polyester resin (MPE) to an unmodified polyester resin (PE) is from 5/95 to 60/40, preferably from 5/95 to 30/70, more preferably from 5/95 to 25/75, even more preferably from 8/92 to 25/75, even more preferably from 10/90 to 25/75, even more preferably from 12/88 to 25/75 and most preferably from 12/88 to 22/78. When the addition amount of the modified polyester resin is too small, the hot offset resistance of the toner deteriorates and in addition, it is impossible to achieve a good combination of high-temperature preservability and low temperature fixability.

The peak molecular weight of the unmodified polyester resins is from 1,000 to 30,000, preferably from 1,500 to 10,000 and more preferably from 2,000 to 8,000. When the peak molecular weight is too low, the high-temperature preservability deteriorates. When the peak molecular weight is too high, the low temperature fixability deteriorates.

The polyester resins to be included in the toner of the present invention preferably has such a molecular weight distribution (for THF soluble components therein) that a molecular weight peak is observed at a range of from 1,000 to 30,000 and components having a molecular weight not less than 30,000 are included in an amount not less than 1% by weight, in view of low temperature fixability and offset resistance. The reason why the content of high molecular weight components is relatively low in the toner of the present invention is that functional groups of the modified polyesters other than ester bondings have a strong cohesive force due to hydrogen bonding, and thereby various properties of the toner, which cannot be controlled by crosslinking a resin and/or changing molecular weight of the resin, can be controlled.

In addition, in the molecular weight distribution of the polyester resins, components having a molecular weight not greater than 1,000 are preferably included in an amount of from 0.1 to 5.0% by weight. When the content of low molecular weight components is too high, the offset resistance deteriorates. It is difficult and costly to reduce the content of low molecular weight components to an amount not greater than 0.1% by weight.

It is preferable for the unmodified polyester resins to have a hydroxyl value not less than 5 mgKOH/g, preferably from 10 to 120 mgKOH/g, and more preferably from 20 to 80 mgKOH/g. When the hydroxyl value is too low, it is impossible to impart a good combination of high-temperature preservability and low temperature fixability to the toner.

It is preferable for the unmodified polyester resins to have an acid value of from 0.5 to 40 mgKOH/g, and more preferably from 5 to 35 mgKOH/g.

When an unmodified polyester having such an acid value is used, the resultant toner is uniformly charged negatively.

When a polyester resin having too large an acid value and a hydroxyl value is used, the charging properties of the toner are seriously changed under high temperature and high humidity conditions, and low temperature and low humidity conditions, and thereby the image qualities deteriorate.

The acid value and the hydroxyl value are measured by a method specified in JIS K0070. When a sample is not dissolved by the solvent, dioxane or tetrahydrofuran is used as a solvent.

The weight ratio (i/ii) of the urea-modified polyester resin (i) and the second binder resin (ii) is generally from 5/95 to 60/40, preferably from 5/95 to 30/70, more preferably from 5/95 to 25/75, even more preferably from 8/92 to 25/75, even more preferably from 10/90 to 25/75, even more preferably from 12/88 to 25/75 and most preferably from 12/88 to 22/78. When the content of the urea-modified polyester resin is too low, the resultant toner has poor hot offset resistance. In contrast, when the content of the urea-modified polyester resin is too high, the resultant toner has poor low temperature fixability.

In addition, resins other than the urea-modified polyester resins (i) and the second binder resin (ii) can be included in the toner in an amount such that the fixing properties of the resultant toner are not deteriorated. However, the binder resin (i.e., a combination of the urea-modified polyester resin (i), the second binder resin (ii) and other resins) of the toner preferably has a glass transition temperature (Tg) not lower than 35° C. and lower than 55° C.

When the Tg of the toner is too high, the resultant toner has poor low temperature fixability. In contrast, when the Tg is too low, the resultant toner has poor preservability and thereby the blocking problem in that the toner particles adhere to each other, resulting in formation of a block of the toner tends to occur.

In the present invention, the glass transition temperature of the binder resin and toner was measured by a TG-DSC system TAS-100 manufactured by RIGAKU CORPORATION. The procedure for measurements of glass transition temperature is as follows:

1) a sample of about 10 mg is contained in an aluminum container, and the container is set on a holder unit;
2) the holder unit is set in an electrical furnace, and the sample is heated from room temperature to 150° C. at a temperature rising speed of 10° C./min;
3) after the sample is allowed to settle at 150° C. for 10 minutes, the sample is cooled to room temperature; and
4) after the sample is allowed to settle at room temperature for 10 minutes, the sample is again heated under a nitrogen atmosphere from room temperature to 150° C. at a temperature rising speed of 10° C./min to perform a DSC measurement.

The glass transition temperature of the sample was determined using an analysis system of the TAS-100 system. Namely, the glass transition temperature is defined as the contact point between the tangent line of the endothermic curve at the temperatures near the glass transition temperature and the base line of the DSC curve.

The binder resin included in the toner of the present invention preferably includes THF (tetrahydrofuran)-insoluble moieties (or THF-insoluble components) therein to impart good offset resistance to the toner. Such THF(tetrahydrofuran)-insoluble moieties can be incorporated in a resin by a known method using a monomer having three or more functional groups when synthesizing the resin. Specifically, urea-modified polyester resins prepared by using a prepolymer having an isocyanate group in an amount of from 1.5 to 3.0 pieces in average, and preferably from 2.1 to 2.8 pieces in average, in a molecule of the prepolymer are preferably used as the urea-modified polyester resin.

The percentage of THF-insoluble components in the binder resin of the toner of the present invention is preferably from 1 to 30% by weight, and more preferably from 2 to 30% by weight, based on the total weight of the binder resin to impart a good combination of hot offset resistance and low temperature fixability to the resultant toner. Namely, when the percentage of THF-insoluble components is too low, the resultant toner has poor hot offset resistance. In contrast, when the percentage is too large, the toner has poor low temperature fixability. The binder resin may comprise tetrahydrofuran-insoluble components in an amount of from 1 to 15% by weight based on total weight of the binder resin.

In the present invention, the percentage of THF-insoluble components is determined as follows.

The percentage of THF-insoluble components in a binder resin is determined as follows:

(1) a resin sample of about 1.0 gram is precisely weighed;
(2) the resin is mixed with 50 grams of tetrahydrofuran (THF) and is allowed to settle at 20° C. for 24 hours;
(3) the mixture is filtered using a filter paper 5C specified in JIS (Japanese Industrial Standards) P3801 whose weight is preliminarily measured;
(4) the filter paper is dried to remove THF therefrom; and
(5) the filter paper is weighed to determine the weight of a residue in the filter paper.

The percentage of THF-insoluble components in the binder resin included in a toner is determined as follows:

(1) a toner sample of about 1.0 gram is precisely weighed;
(2) the toner is mixed with 50 grams of THF and is allowed to settle at 20° C. for 24 hours;
(3) the mixture is filtered using a filter paper 5C specified in JIS (Japanese Industrial Standards) P3801 whose weight is preliminarily measured;
(4) the filter paper is dried to remove THF therefrom; and
(5) the filter paper is weighed to determine the weight of the THF insoluble materials.

At this point, the weight of the THF-insoluble solids included in the toner, such as colorants and waxes, should be subtracted from the weight of the THF insoluble materials, which is determined by another method such as thermometric analysis, to determine the THF-insoluble components in the binder resin in the toner.

The molecular weight distribution of the components in the toner, which are soluble in tetrahydrofuran, is measured as follows:

(1) a toner of about 1 gram is precisely weighed;
(2) the toner is mixed with tetrahydrofuran to prepare a tetrahydrofuran solution of the THF-soluble components at a concentration of from 0.05 to 0.6% by weight;
(3) the sample solution is filtered using a filter for liquid chromatography to remove THF-insoluble components therefrom;
(4) tetrahydrofuran is flown through a column, which is heated to 40° C. in a heat chamber, at a flow rate of 1 ml/min and 200 μl of the sample solution is injected thereto to determine the molecular weight distribution of the binder resin using a working curve which shows the relationship between a molecular weight and counts detected by GPC (gel permeation chromatography) and which is previously prepared using at least ten polystyrenes having a single molecular distribution such as $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$, which are prepared by Pressure Chemical Co., or Tosoh Corporation.

As the detector, a refractive index (RI) detector is used. The tetrahydrofuran-soluble components of the modified polyester resin and the unmodified polyester resin may have a number average molecular weight of from 2,000 to 15,000.

The toner of the present invention preferably has a storage modulus of 10,000 dyne/cm$^2$ at a temperature (TG') not lower than 100° C., and more preferably from 110 to 200° C. when measured at a frequency of 20 Hz. When the temperature TG' is too low, the toner has poor hot offset resistance.

In addition, the toner of the present invention preferably has a viscosity of 1,000 poise at a temperature (Tη) not higher than 180° C., and more preferably from 80 to 160° C. When the temperature Tη is too high, the low temperature fixability of the toner deteriorates.

Namely, in view of low temperature fixability and hot offset resistance, the temperature TG' of the toner is preferably not lower than the temperature Tη, i.e., the difference between TG' and Tη is not less than 0. Preferably, the difference is not less than 10° C. and more preferably not less than 20° C. In addition, in view of preservability and low temperature fixability, the difference (TG'−Tη) is preferably from 0 to 100° C., more preferably from 10 to 90° C., and even more preferably from 20 to 80° C.

Further, the toner of the present invention preferably has a flow starting temperature (Tfb) of from 80 to 170° C. in view of low temperature fixability and offset resistance.

Release Agent

The toner of the present invention includes a release agent. Known release agents for use in conventional toners can be used in the toner of the present invention.

Suitable release agents include polyolefin waxes (e.g., polyethylene waxes and polypropylene waxes); hydrocarbons having a long chain (e.g., paraffin waxes and SASOL waxes); and waxes having a carbonyl group. Among these materials, waxes having a carbonyl group are preferably used for the toner of the present invention.

Specific examples of the waxes including a carbonyl group include polyalkanoic acid esters such as carnauba wax, montan waxes, trimethylolpropane tribehenate, pentaerythritol tetrabehenate, pentaerythritol diacetate dibehenate, glycerin tribehenate, and 1,18-octadecanediol distearate; polyalkanol esters such as tristearyl trimellitate, and distearyl maleate; polyalkanoic acid amides such as ethylenediamine dibehenylamide; polyalkylamide such as trimellitic acid tristearylamide; dialkyl ketone such as distearyl ketone; etc. Among these materials, polyalkanoic acid esters are preferable.

The release agent for use in the toner of the present invention preferably has a melting point of from 60 to 120° C., to impart good low temperature fixability to the toner.

The content of the release agent in the toner is preferably from 3 to 30% by weight based on total weight of the toner. In this case, the resultant toner has a good releasing property without causing a spent-carrier problem, a toner filming problem, a developing ability decreasing problem and a transferability decreasing problem.

Particulate Material

The toner of the present invention includes a particulate material, which is present on at least the surface of the toner particles while embedded thereinto.

Suitable particulate materials include particulate resins and inorganic particulate materials.

Particulate Resin

As the particulate resin for use in the toner of the present invention, known particulate resins can be used if the resins can be dispersed in an aqueous liquid.

Specific examples of the particulate resins include particles of vinyl resins, polyurethane resins, epoxy resins, polyester resins, polyamide resins, polyimide resins, silicone resins, phenolic resins, melamine resins, urea resins, aniline resins, ionomer resins, polycarbonate resins, etc. These resins can be used alone or in combination.

Among these resins, vinyl resins, polyurethane resins, epoxy resins and polyester resins can be preferably used because aqueous dispersions in which fine spherical resin particles are dispersed in an aqueous liquid can be easily obtained.

Suitable vinyl resins include homopolymers and copolymers of one or more vinyl monomers. Specific examples thereof include styrene-(meth)acrylate copolymers, styrene-butadiene copolymers, (meth)acrylic acid-acrylate copolymers, styrene-acrylonitrile copolymers, styrene-maleic anhydride copolymers, styrene-(meth)acrylic acid copolymers, etc.

The particulate resin for use in the toner of the present invention is a resin having units obtained from styrene and methacrylic acid and satisfying the following relationship:

$$10 \leqq a \leqq 51,\ 15 \leqq b \leqq 51,\ \text{and}\ 0.4 \leqq a/b \leqq 2.5,$$

wherein a and b respectively represent weight ratios of styrene and methacrylic acid based on total monomers constituting the particulate resin. By using such a particulate resin, the resultant toner has good charging ability, and a sharp particle diameter distribution. In addition, the toner particles including the particulate resin thereon can be easily prepared.

If the above-mentioned relationships are satisfied, monomers other than styrene and methacrylic acid can be copolymerized. Specific examples of the other monomers include ethylene, propylene, methylpentene, butene, butadiene, acrylic acid, methyl acrylate, ethyl acrylate, butyl acrylate, 2-ethylhexyl acrylate, methyl methacrylate, maleic anhydride, fumaric acid, phthalic anhydride, acrylonitrile, etc.

In addition, in order to prepare a toner having a sharp particle diameter distribution, it is preferable that the ratio Dv/Dn of the volume average particle diameter (Dv) of the particulate resin to the number average particle diameter (Dn) thereof is less than 1.25, and the Dv is from 3 to 500 nm and more preferably from 50 to 200 nm.

The average particle diameter of the particulate resin for use in the toner of the present invention is from 0.002 to 0.2 times the average particle diameter of the toner. When the particle diameter is too small, the resultant toner has poor preservability. In contrast, the particle diameter is too large, the resultant toner has poor low temperature fixability.

The particulate resin preferably has an average particle diameter of from 50 to 400 nm. When the particulate diameter is too small, the particulate resin tends to form a film on the surface of the toner particles or covers entire surface of the toner particles, and thereby the adhesion of the binder resin in the toner particles to receiving materials is deteriorated, resulting in increase of minimum fixing temperature. In addition, it becomes impossible to control the particle diameter and the shape of the toner particles.

In contrast, when the particle diameter is too large, the particulate resin is present on the surface of the toner particles as a large projection. Therefore, the particulate resin tends to be easily released from the surface, for example, when a stress such as agitation in a developing device is applied thereto.

The particle diameter (volume average particle diameter) of the particulate resin can be measured by a laser diffraction/scattering type particle diameter measuring instrument LA-920 manufactured by Horiba Ltd.

The surface of the toner particles is preferably covered by the particulate resin at a cover rate of from 40 to 80% while the particulate resin is embedded into the toner surface.

When the surface of the toner particles is covered by a continuous layer (i.e., a shell), the toner has poor fixing property. However, when the surface is covered by a discontinuous layer (i.e., a particulate resin), the toner has good fixability and good preservability. This is because the binder resin of the toner easily adheres to a receiving material during fixing (resulting in improvement of good fixability), while contact areas of toner particles decrease (resulting in improvement of preservability).

The particulate resin for use in the toner of the present invention preferably has a Tg of from 40 to 100° C. and more preferably from 55 to 100° C. When the Tg is too low, the resultant toner has poor preservability, and when the Tg is too high, the resultant toner has poor low temperature fixability.

In addition, when the particulate resin is crosslinked, the toner has good mechanical strength. In this case, the particulate resin has good resistance to organic solvents used for preparing toner particles, and thereby the particulate resin is present on the surface of the toner particles while maintaining its form.

The particulate resin preferably has a weight average molecular weight of from 9,000 to 200,000. The content of the particulate resin in the toner is preferably from 0.5 to 5.0% by weight. The content means the percentage of the particulate resin remaining on the surface of the toner particles which have been subjected to a washing treatment.

When the weight average molecular weight is too low, the resultant toner has poor preservability, i.e., a blocking problem in that toner particles adhere to each other in a developing device or during preservation tends to occur.

In contrast, when the weight average molecular weight is too high, the adhesion of the toner to receiving materials deteriorate, resulting in increase of the minimum fixing temperature.

When the content of the particulate resin is too low, the resultant toner has poor preservability. In contrast, when the content is too high, the particulate resin prevents the wax included in the toner particles from exuding, and thereby the offset resistance of the toner is deteriorated.

The content of the particulate resin can be controlled by changing the addition quantity of the particulate resin of changing the washing conditions when preparing the toner particles.

The content of the particulate resin can be determined by determining the quantity of a material which is formed by subjecting the particulate resin to pyrolysis gas chromatography but which is not formed by subjecting the constituents of the toner other than the particulate resin to the pyrolysis gas chromatography. The quantity of such a material can be determined by calculating the area of a peak specific to the material. As the detector, a mass spectrometer is preferable, but the detector is not limited thereto.

Inorganic Particulate Material

As the inorganic particulate material for use in the toner of the present invention, known inorganic particulate materials can be used if the materials can be dispersed in an aqueous liquid.

Specific examples of such inorganic particulate materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

Among these materials, silica and titanium oxide are preferably used when the toner is used as a negatively charged toner, and alumina and titanium oxide are preferably used when the toner is used as a positively charged toner.

The average particle diameter of the inorganic particulate materials for use in the toner of the present invention is from 0.002 to 0.2 times the average particle diameter of the toner. When the particle diameter is too small, the resultant toner has poor preservability. In contrast, the particle diameter is too large, the resultant toner has poor low temperature fixability.

The surface of the toner particles is preferably covered by the inorganic particulate material at a cover rate of from 40 to 80% while the inorganic particulate material is embedded into the toner surface.

These particulate materials (i.e., the particulate resins and inorganic particulate materials) can be used alone or in combination.

The particulate material is included in an aqueous medium to prepare an aqueous phase liquid. A composition including at least a binder resin, a colorant and a release agent is dissolved or dispersed in an organic solvent to prepare an oil phase liquid. Then the oil phase liquid is dispersed in the aqueous phase liquid to adhere the particulate material in the aqueous phase to the particles of the composition, i.e., particles of the oil phase liquid. In this case, by agitating this emulsion, the particulate material is properly embedded into the surface of the composition.

The toner of the present invention preferably has a circularity of from 0.975 to 0.900.

The circularity can be determined using a flow-type particle image analyzer, FPIA-2100 manufactured by To a Medical Electronics Co., Ltd.

When the toner has an average circularity less than 0.900, i.e., when the toner composition has a form largely different from a spherical form, high quality images cannot be produced (for example, transferability deteriorates and the resultant images have background fouling).

In the present invention, the circularity of a toner is measured as follows:

(1) a suspension including particles to be measured is passed through a detection area formed on a plate in the measuring instrument; and (2) the particles are optically detected by a CCD camera and then the shapes thereof are analyzed.

The circularity of a particle is determined by the following equation:

$$\text{Circularity}=Cs/Cp$$

wherein Cp represents the length of the circumference of the projected image of a particle and Cs represents the length of the circumference of a circle having the same area as that of the projected image of the particle.

The average circularity is preferably from 0.975 to 0.900 to stably produce images having a proper image density and good resolution. More preferably, the circularity is from 0.970 to 0.950 while the percentage of particles having a circularity less than 0.940 is not greater than 15%.

When the circularity is too large, a problem in that toner particles remaining on image bearing members such as photoreceptors and intermediate transfer media cannot be well removed by a cleaning blade, and thereby background fouling is caused on the resultant images tends to occur.

This problem is frequently caused when images having a high image area proportion such as color photograph images or when a large amount of toner remains on image bearing members due to paper mis-feeding or the like.

The toner of the present invention preferably has a spindle form.

When the toner has an irregular form or a flat form, the toner has poor fluidity, and thereby the toner has the following drawbacks.

(1) since the toner is not well friction-charged, and thereby background fouling is caused in the resultant images;

(2) images having high resolution cannot be produced because the toner particles do not have a dense structure; and (3) since the toner is hardly influenced by an electric force, the toner has poor transferability when an electrostatic toner transferring process is adopted.

When the toner has almost the true spherical form, the fluidity of the toner is too good, and thereby the toner excessively reacts to external forces, and thereby a problem in that toner particles scatter when toner images are formed or transferred, resulting in formation of images having low resolution tends to occur. In addition, the spherical toner is easily rotated on the surface of a photoreceptor, and thereby a problem in that toner particles on a photoreceptor cannot be well removed by a cleaning member from the surface of the photoreceptor tends to occur.

When a toner has a spindle form, the toner has a proper fluidity, and thereby images having good dot reproducibility can be formed without causing background fouling because the toner is smoothly friction-charged. Since the toner has a proper fluidity, the above-mentioned scattering problem is not caused. In addition, since a toner having a spindle form is rotated in only a specific direction whereas a spherical toner is rotated in any direction, the above-mentioned cleaning problem is not caused.

Figure 2B:
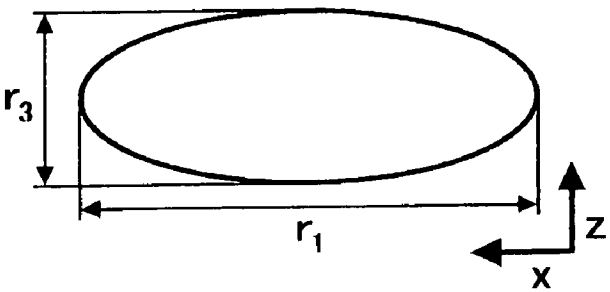
FIGS. 2A to 2C are schematic views for explaining particle diameter ratios r2/r1 and r3/r2 of toner particles.
Figure 2C:
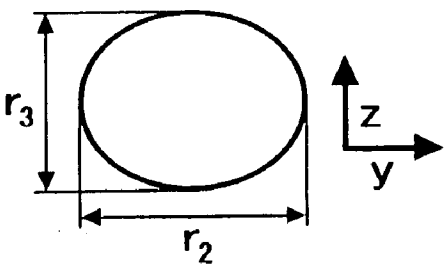
Figure 2A:
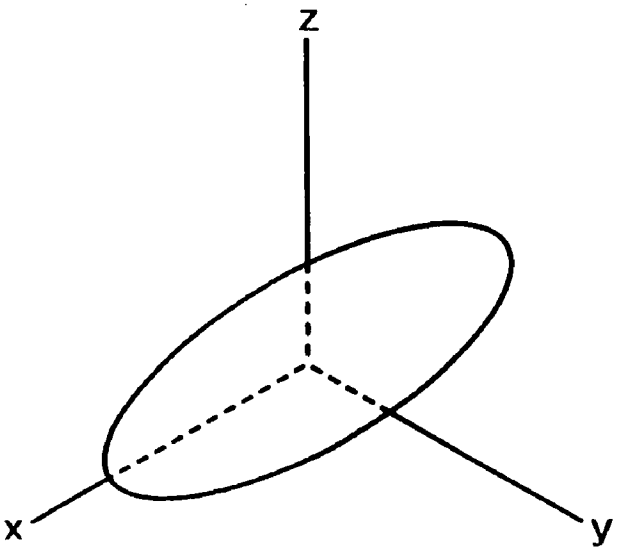

The toner having a spindle form will be explained referring to FIGS. 2A to 2C.

It is preferable for the toner to have such a spindle form that the ratio (r2/r1) of the minor axis particle diameter (r2) to the major axis particle diameter (r1) is from 0.5 to 0.8, and the ratio (r3/r2) of the thickness (r3) to the minor axis particle diameter (r2) is from 0.7 to 1.0.

When the ratio (r2/r1) is too small, the toner has good cleanability but high quality images cannot be produced because the toner has poor dot reproducibility and transferability. In contrast, when the ratio (r2/r1) is too large, the toner has a form near spherical form, and thereby the cleaning problem tends to occur particularly under low temperature and low humidity conditions.

When the ratio (r3/r2) is too small, the toner has a form near a flat form, and thereby the toner has low transferability although the scattering problem is hardly caused. When the ratio (r3/r2) is 1.0, the toner can be rotated while the major axis is a rotation axis. When the toner has a ratio (r3/r2) of about 1.0, i.e., when the toner has a form which is different from an irregular form, a flat form or a spherical form, the toner has a good combination of friction charging ability, dot reproducibility, transferability, scattering resistance, and cleanability.

The diameters and thickness, r1, r2 and r3, are measured using a scanning electron microscope while the viewing angle is changed.

The volume average particle diameter of the toner are preferably from 3 to 7 μm. The ratio (Dv/Dn) of the volume average particle diameter (Dv) to the number average particle diameter (Dn) is preferably not greater than 1.25. More preferably the ratio (Dv/Dn) are preferably from 1.05 to 1.20 to impart good combination of preservability, low temperature fixability and offset resistance to the toner. In particular, when such a toner is used as a color toner, the toner images have high gloss. Further, even when a two component developer including such a toner is used for a long period of time while a fresh toner is replenished, the particle diameter of the toner in the developer hardly changes even when the developer is agitated for a long period of time, and thereby images having good image qualities can be stably produced.

In addition, when such a toner is used as a one component developer, the particle diameter of the toner hardly changes even when the toner is used for a long period of time while a fresh toner is replenished, and thereby images having good image qualities can be stably produced for a long period of time without causing problems such that a film of the toner is formed on the developing roller used, and the toner adheres to the toner layer regulating member (such as blades) used.

In general, it can be said that the smaller particle diameter toner particles have, the higher resolution images the toner particles can produce. However, toner having a small particle diameter is disadvantageous in view of transferability and cleanability.

A toner having a volume average particle diameter out of the above-mentioned range tends to cause problems in that the toner adheres to the carrier used when the developer is agitated for a long period of time in a developing device; and when used as a one component developer, a film of the toner is formed on the developing roller used and the toner adheres to the toner layer regulating member used.

The same is true for a toner including a large amount of fine particles.

In contrast, when the particle diameter is too large, high resolution images can be hardly produced, and in addition, the average particle diameter of the toner easily changes when the toner is used for a long period of time while a fresh toner is replenished, resulting in change of image qualities.

Colorant

The toner of the present invention includes a colorant as an essential material.

Suitable colorants for use in the toner of the present invention include known dyes and pigments. Specific examples of the colorants include carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), PIGMENT YELLOW L, BENZIDINE YELLOW (G and GR), PERMANENT YELLOW (NCG), VULCAN FAST YELLOW (5G and R), Tartrazine Lake, QUINOLINE YELLOW LAKE, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS AND BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1 to 15% by weight, and more preferably from 3 to 10% by weight of the toner.

Master batches, which are complexes of the colorants as mentioned above with resins, can be used as the colorant of the toner of the present invention.

Specific examples of the resins for use as the binder resin of the master batches include the modified and unmodified polyester resins as mentioned above, styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

The master batches can be prepared by mixing one or more of the resins as mentioned above and one or more of the colorants as mentioned above and kneading the mixture while applying a high shearing force thereto. In this case, an organic solvent can be added to increase the interaction between the colorant and the resin. In addition, a flashing method in which an aqueous paste including a colorant and water is mixed with a resin dissolved in an organic solvent and kneaded so that the colorant is transferred to the resin side (i.e., the oil phase), and then the organic solvent (and water, if desired) is removed can be preferably used because the resultant wet cake can be used as it is without being dried. When performing the mixing and kneading process, dispersing devices capable of applying a high shearing force such as three roll mills can be preferably used.

Charge Controlling Agent

The toner of the present invention optionally includes a charge controlling agent. Known charge controlling agents can be used for the toner of the present invention. However, when the toner is a color toner other than a black toner, colorless, white colored or pale colored charge controlling agents are preferably used.

Specific examples of the charge controlling agent include triphenyl methane dyes, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, metal salts of salicylic acid derivatives, etc.

Specific examples of the marketed products of the charge controlling agents include BONTRON P-51 (quaternary ammonium salt), BONTRON E-82 (metal complex of oxynaphthoic acid), BONTRON E-84 (metal complex of salicylic acid), and BONTRON E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenylmethane derivative), COPY CHARGE NEG VP2036 and COPY CHARGE NX VP434 (quaternary ammonium salt), which are manufactured by Hoechst AG; LRA-901, and LR-147 (boron complex), which are manufactured by Japan Carlit Co., Ltd.; quinacridone, azo pigments, and polymers having a functional group such as a sulfonate group, a carboxyl group, a quaternary ammonium group, etc.

It is preferable that the charge controlling agent is included in the toner in an amount of from 0.1 to 5 parts by weight per 100 parts by weight of the binder resin. The charge controlling agent can be preliminarily mixed and kneaded with a composition (i.e., a binder resin, a colorant and a release agent), or can be added to an organic solvent when the composition is dissolved or dispersed in the organic solvent. Alternatively, the charge controlling agent may be mixed with toner particles prepared so as to be fixed on the surface thereof.

External Additive

The toner of the present invention preferably includes an external additive. The external additive is present at least on a surface of the toner particles.

Inorganic fine particles are typically used as an external additive. Inorganic particulate materials having a primary particle diameter of from 5 nm to 2 μm, and preferably from 5 nm to 500 nm, are used. The surface area of the inorganic particulate materials is preferably from 20 to 500 $m^2/g$ when measured by a BET method.

The content of the inorganic particulate material in the toner is preferably from 0.01% to 5.0% by weight, and more preferably from 0.01% to 2.0% by weight, based on the total weight of the toner.

Specific examples of such inorganic particulate materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

The external additive is preferably subjected to a hydrophobizing treatment to prevent deterioration of the fluidity and charge properties of the resultant toner particularly under high humidity conditions. Suitable hydrophobizing agents for use in the hydrophobizing treatment include silane coupling agents, silylation agents, silane coupling agents having a fluorinated alkyl group, organic titanate coupling agents, aluminum coupling agents, silicone oils, modified silicone oils, etc.

In addition, the toner preferably includes a cleanability improving agent which can impart good cleaning property to the toner such that particles of the toner, which remain on the surface of an image bearing member such as a photoreceptor even after a toner image is transferred, can be easily removed. Specific examples of such a cleanability improving agent include fatty acids and their metal salts such as stearic acid, zinc stearate, and calcium stearate; and particulate polymers such as polymethyl methacrylate and polystyrene, which are manufactured by a method such as soap-free emulsion polymerization methods.

The toner of the present invention is prepared, for example, by the following method, but the manufacturing method is not limited thereto.

Toner Manufacturing Method in Aqueous Medium

Suitable aqueous media for use in the toner manufacturing method of the present invention include water and mixtures of water and a solvent which can be mixed with water. Specific examples of such a solvent include alcohols (e.g., methanol, isopropanol and ethylene glycol), dimethylformamide, tetrahydrofuran, cellosolves (e.g., methyl cellosolve), lower ketones (e.g., acetone and methyl ethyl ketone), etc.

An emulsifier and a particulate material as mentioned above (i.e., a particulate resin and/or an inorganic particulate material) are dissolved/dispersed in an aqueous medium to prepare an aqueous phase liquid.

Toner particles can be prepared as follows:

(1) a composition including a prepolymer (A) having an isocyanate group, a second binder resin having a relatively low molecular weight, a colorant and a release agent (optionally additives such as a charge controlling agent) is dissolved/dispersed in an organic solvent to prepare a dispersion (i.e., an oil phase liquid);
(2) the dispersion is mixed with an amine (B);
(3) the mixture is dispersed in the aqueous phase liquid while a shearing force is applied thereto to prepare an emulsion having a desired particle diameter;
(4) the emulsion is optionally heated to perform a urea reaction of the prepolymer (A) with the amine (B);
(5) the solvents are removed from the reaction product to obtain particles; and
(6) the particles are washed and dried, resulting in formation of toner particles in which the particulate material is adhered to the surface of the toner particles while embedded thereinto.

Before the composition is dissolved/dispersed in an organic solvent, toner constituents such as the colorant, release agent and charge controlling agent are preferably mixed such that the components are finely dispersed in the mixture.

Organic Solvent for se in Oil Phase Liquid

As the organic solvent for use in dissolving the composition, known organic solvents can be used if the solvents can dissolve or disperse the composition. Suitable organic solvents include solvents which are volatile and have a boiling point less than 150° C. in view of removability.

Specific examples of the organic solvents include toluene, xylene, benzene, carbon tetrachloride, methylene chloride, 1,2-dichloroethane, 1,1,2-trichloroethane, trichloroethylene, chloroform, monochlorobenzene, methyl acetate, ethyl acetate, methyl ethyl ketone, acetone, tetrahydrofuran, etc. These solvents can be used alone or in combination.

The addition amount of the organic solvent is from 40 to 300 parts by weight, preferably from 60 to 140 parts by weight, and more preferably from 80 to 120 parts by weight, per 100 parts by weight of the composition (i.e., the toner constituents).

In addition, a toner manufacturing method in which at first particles including no colorant are prepared and then the particles are dyed with a colorant using a known dyeing method.

The toner manufacturing method is further explained in detail.

The method for preparing the emulsion is not particularly limited, and low speed shearing methods, high speed shearing methods, friction methods, high pressure jet methods, ultrasonic methods, etc. can be used. Among these methods, high speed shearing methods are preferable because particles having a particle diameter of from 2 μm to 20 μm can be easily prepared. At this point, the particle diameter (2 to 20 μm) means a particle diameter of particles including a liquid).

When a high speed shearing type dispersion machine is used, the rotation speed is not particularly limited, but the rotation speed is typically from 1,000 to 30,000 rpm, and preferably from 5,000 to 20,000 rpm. The dispersion time is not also particularly limited, but is typically from 0.5 to 15 minutes for a batch production method. The temperature in the dispersion process is typically from 0 to 150° C. (under pressure), and preferably from 20 to 80° C.

When the emulsion is prepared, the weight ratio (T/M) of the composition (T) (including a prepolymer (A)) to the aqueous medium (M) is typically from 100/50 to 100/2,000, and preferably from 100/100 to 100/1,000. When the ratio is too large (i.e., the quantity of the aqueous medium is small), the dispersion of the toner constituents in the aqueous medium is not satisfactory, and thereby the resultant toner particles do not have a desired particle diameter. In contrast, when the ratio is too small, the manufacturing costs increase.

When the emulsion is prepared, a dispersant can be preferably used so that the emulsion includes particles having a sharp particle diameter distribution and the emulsion has good dispersion stability.

Specific examples of the dispersants which are used for emulsifying an oil phase liquid, in which toner constituents are dissolved or dispersed, in an aqueous phase liquid, include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di)octylaminoethyle)glycin, and N-alkyl-N,N-dimethylammonium betaine.

By using a surfactant having a fluoroalkyl group, a dispersion having good dispersibility can be prepared even when the amount of the surfactant is small. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4)sulfonate, sodium 3-{omega-fluoroalkanoyl (C6-C8)-N-ethylamino}-1-propanesulfonate, fluoroalkyl (C11-C20)carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16)ethylphosphates, etc.

Specific examples of the marketed products of such surfactants include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of the cationic surfactants, which can disperse an oil phase liquid including toner constituents in water, include primary, secondary and tertiary aliphatic amines having a fluoroalkyl group, aliphatic quaternary ammonium salts such as perfluoroalkyl(C6-C10)sulfoneamidepropyltrimethylammonium salts, benzalkonium salts, benzetonium chloride, pyridinium salts, imidazolinium salts, etc. Specific examples of the marketed products thereof include SURFLON S-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

In addition, inorganic dispersants, which are hardly soluble in water, such as tricalcium phosphate, calcium carbonate, titanium oxide, colloidal silica, and hydroxyapatite can also be used.

Further, it is possible to stably disperse (emulsify) toner constituents in water using a polymeric protection colloid. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate) acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

When compounds such as calcium phosphate which are soluble in an acid or alkali are used as a dispersion stabilizer, the resultant toner particles are preferably mixed with an acid such as hydrochloric acid, followed by washing with water to remove calcium phosphate from the toner particles. In addition, calcium phosphate can be removed using a zymolytic method.

When a dispersant is used, the resultant particles are preferably washed after the particles are subjected to an elongation and/or a crosslinking reaction to impart good charge ability to the particles.

When an aqueous dispersion or emulsion is prepared, a solvent which can dissolve the urea-modified polyester or prepolymer (A) used is preferably used because the resultant particles have a sharp particle diameter distribution. The solvent is preferably volatile and has a boiling point lower than 100° C. because of easily removed from the dispersion after the particles are formed.

Specific examples of such a solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These solvents can be used alone or in combination. Among these solvents, aromatic solvents such as toluene and xylene; and halogenated hydrocarbons such as methylene chloride, 1,2-dichloroethane, chloroform, and carbon tetrachloride are preferably used.

The addition amount of such a solvent is from 0 to 300 parts by weight, preferably from 0 to 100 and more preferably from 25 to 70 parts by weight, per 100 parts by weight of the prepolymer (A) used. When such a solvent is used to prepare a particle dispersion, the solvent is removed upon application of heat thereto under a normal or reduced pressure after the particles are subjected to an extension treatment and/or a crosslinking treatment.

When a urea-modified polyester (i) is synthesized using a prepolymer (A), an amine (B) may be added to an aqueous medium before or after a composition including the prepolymer (A) is added to the aqueous medium. In the latter case, the reaction is performed from the surface of the particles of the composition, and thereby the content of the urea-modified polyester (i) is changed in the depth direction of the particles.

The reaction time of extension and/or crosslinking is determined depending on the reacting property of the prepolymer (A) and the amine (B) used, but the reaction time is generally from 10 minutes to 40 hours, and preferably 2 hours to 24 hours. The reacting temperature is generally from 0 to 150° C. and preferably from 20 to 80° C. In addition, a known catalyst can optionally be used. Specific examples of the catalyst include dibutyltin laurate and dioctyltin laurate.

In order to remove an organic solvent from the thus prepared emulsion, a method in which the emulsion is gradually heated to perfectly evaporate the organic solvent included in the drops of the oil phase liquid can be used. Alternatively, a method in which the emulsion is sprayed in a dry environment to dry the organic solvent in the drops of the oil phase liquid and water in the dispersion, resulting in formation of toner particles, can be used. Specific examples of such a dry environment include gases of air, nitrogen, carbon dioxide, combustion gas, etc., which are preferably heated to a temperature not lower than the boiling point of the solvent having the highest boiling point among the solvents used in the emulsion or dispersion. Toner particles having desired properties can be rapidly prepared by performing this treatment using a spray dryer, a belt dryer, a rotary kiln, or the like.

When the thus prepared toner particles have a wide particle diameter distribution even after the particles are subjected to a washing treatment and a drying treatment, the toner particles are preferably subjected to a classification treatment using a cyclone, a decanter or a method utilizing centrifuge to remove fine particles therefrom. However, it is preferable to perform the classification operation in the liquid having the particles in view of efficiency.

The thus prepared toner particles are then mixed with one or more other particulate materials such as charge controlling agents, fluidizers and colorants optionally upon application of mechanical impact thereto to fix the particulate materials on the toner particles.

Specific examples of such mechanical impact application methods include methods in which a mixture is mixed with a highly rotated blade and methods in which a mixture is put into a jet air to collide the particles against each other or a collision plate.

Specific examples of such mechanical impact applicators include ONG MILL (manufactured by Hosokawa Micron Co., Ltd.) modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTRON SYSTEM (manufactured by Kawasaki Heavy Industries, Ltd.), automatic mortars, etc.

Then the developer of the present invention will be explained in detail.

The toner of the present invention can be used for a two-component developer in which the toner is mixed with a magnetic carrier. The weight ratio (T/C) of the toner (T) to the carrier (C) is preferably from 1/100 to 10/100.

Suitable carriers for use in the two component developer include known carrier materials such as iron powders, ferrite powders, magnetite powders, magnetic resin carriers, which have a particle diameter of from about 20 μm to about 200 μm. The surface of the carriers may be coated by a resin.

Specific examples of such resins to be coated on the carriers include amino resins such as urea-formaldehyde resins, melamine resins, benzoguanamine resins, urea resins, and polyamide resins, and epoxy resins. In addition, vinyl or vinylidene resins such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, and silicone resins.

If desired, an electroconductive powder may be included in the coating layer. Specific examples of such electroconductive powders include metal powders, carbon blacks, titanium oxide, tin oxide, and zinc oxide. The average particle diameter of such electroconductive powders is preferably not greater than 1 μm. When the particle diameter is too large, it is hard to control the resistance of the coating layer.

The toner of the present invention can also be used as a one-component magnetic developer or a one-component non-magnetic developer, which does not use a carrier.

Then the fixing method and apparatus will be explained.

Figure 3:
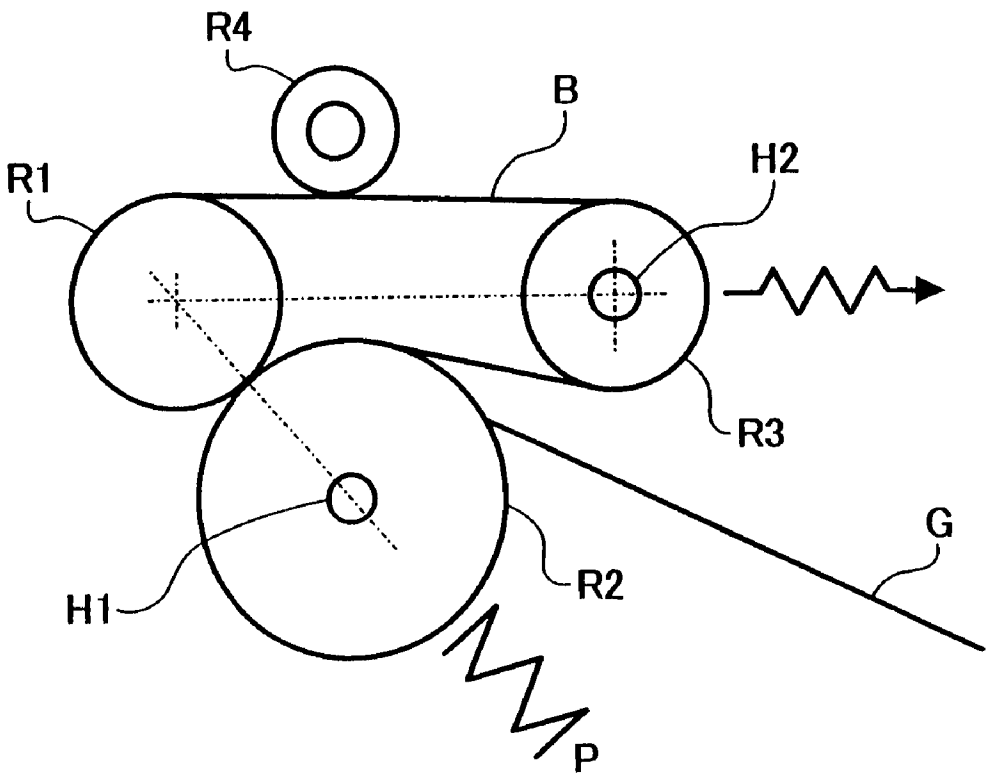
FIG. 3 is a schematic view illustrating a fixing device for use in the fixing method of the present invention.

FIG. 3 is a schematic view illustrating an embodiment of the fixing device of the present invention.

In FIG. 3, numerals R1, R2 and R3 represent a fixing roller, a pressure roller having a heater H1, and a heat roller having a heater H2, respectively. A fixing belt B is rotated by the fixing roller R1 and the heat roller R3 while stretched. The pressure roller R2 is pressed toward the fixing roller R1 by a spring P. At the nip between the pressure roller R2 and the fixing belt B, the fixing belt has a U form. A cleaning roller R4 is brought into contact with the fixing belt B to clean the surface of the fixing belt B. In addition, a guide G is arranged to guide a receiving paper with a toner image (not shown)

toward the nip between the fixing belt B and the pressure roller R2. The toner image is fixed on the receiving paper by the fixing belt B, the fixing roller R1 and the pressure roller R2.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Particulate Resin Dispersion

Manufacturing Example 1

The following components were contained in a reaction container having a stirrer and a thermometer and agitated for 15 minutes by a stirrer at a speed of 400 rpm to prepare a white emulsion.

| | |
|---|---|
| Water | 683 |
| Sodium salt of sulfate of ethylene oxide adduct of methacrylic acid (ELEMINOL RS-30, manufactured by Sanyo Chemical Industries Ltd.) | 11 |
| Styrene | 83 |
| Methacrylic acid | 83 |
| Butyl acrylate | 110 |
| Ammonium persulfate | 1 |

The emulsion was heated to 80° C. to perform a reaction for 5 hours.

Further, 30 parts of a 1% aqueous solution of ammonium persulfate were added thereto drop by drop and the mixture was aged for 5 hours to prepare an aqueous dispersion of a vinyl resin (styrene-methacrylic acid-butyl acrylate-sodium salt of sulfate of ethylene oxide adduct of methacrylic acid copolymer) The volume average particle diameter of the thus prepared fine particle dispersion (1) was 0.09 μm when measured with a particle diameter measuring instrument LA-920 manufactured by Horiba Ltd. Apart of the fine particle dispersion (1) was dried to isolate the resin component. The glass transition temperature (Tg) of the resin component was 58° C.

Manufacturing Example 2

The procedure for preparation of the fine particle dispersion (1) in Manufacturing Example 1 was repeated except that 1 part of a crosslinking agent, divinyl benzene, was mixed with the components in the reaction container.

Thus, a fine particle dispersion (2) was prepared. The volume average particle diameter of the fine particle dispersion (2) was 0.10 μm, and the glass transition temperature (Tg) of the resin component in the fine particle dispersion (2) was 78° C.

Manufacturing Example 3

The procedure for preparation of the fine particle dispersion (1) in Manufacturing Example 1 was repeated except that 110 parts of butyl acrylate were not added and the addition amount of each of styrene and methacrylic acid was changed to 138 parts.

Thus, a fine particle dispersion (3) was prepared. The volume average particle diameter of the fine particle dispersion (3) was 0.11 μm, and the glass transition temperature (Tg) of the resin component in the fine particle dispersion (3) was 150° C.

Preparation of Aqueous Phase Liquid

Manufacturing Example 4

The following components were mixed while agitated to prepare a milky liquid.

| | |
|---|---|
| Deionized water | 1000 |
| Fine particle dispersion (1) | 83 |
| Aqueous solution of sodium salt of dodecyl diphenyl ether disulfonic acid (ELEMINOL MON-7, manufactured by Sanyo Chemical Industries Ltd., solid content of 48.5%) | 37 |
| Ethyl acetate | 90 |

Thus, an aqueous phase liquid (1) was prepared.

Manufacturing Example 5

The following components were mixed while agitated to prepare a milky liquid.

| | |
|---|---|
| Deionized water | 1000 |
| Fine particle dispersion (2) | 83 |
| Aqueous solution of sodium salt of dodecyl diphenyl ether disulfonic acid (ELEMINOL MON-7, manufactured by Sanyo Chemical Industries Ltd., solid content of 48.5%) | 37 |
| Ethyl acetate | 90 |

Thus, an aqueous phase liquid (2) was prepared.

Manufacturing Example 6

The following components were mixed while agitated to prepare a milky liquid.

| | |
|---|---|
| Deionized water | 1000 |
| Particulate silica (AEROSIL 130, manufactured by Nippon Aerosil Co., average primary particle diameter of about 16 nm) | 3 |
| Aqueous solution of sodium salt of dodecyl diphenyl ether disulfonic acid (ELEMINOL MON-7, manufactured by Sanyo Chemical Industries Ltd., solid content of 48.5%) | 37 |
| Ethyl acetate | 90 |

Thus, an aqueous phase liquid (3) was prepared.

Manufacturing Example 7

The following components were mixed while agitated to prepare a milky liquid.

| | |
|---|---|
| Deionized water | 1000 |
| Particulate titanium dioxide (P-25, manufactured by Nippon Aerosil Co., average primary particle diameter of about 21 nm) | 3 |

-continued

| | |
|---|---|
| Aqueous solution of sodium salt of dodecyl diphenyl ether disulfonic acid (ELEMINOL MON-7, manufactured by Sanyo Chemical Industries Ltd., solid content of 48.5%) | 37 |
| Ethyl acetate | 90 |

Thus, an aqueous phase liquid (4) was prepared.

Manufacturing Example 8

The following components were mixed while agitated to prepare a milky liquid.

| | |
|---|---|
| Deionized water | 1000 |
| Fine particle dispersion (1) | 45 |
| Particulate titanium dioxide (P-25, manufactured by Nippon Aerosil Co., average primary particle diameter of about 21 nm) | 2 |
| Aqueous solution of sodium salt of dodecyl diphenyl ether disulfonic acid (ELEMINOL MON-7, manufactured by Sanyo Chemical Industries Ltd., solid content of 48.5%) | 37 |
| Ethyl acetate | 90 |

Thus, an aqueous phase liquid (5) was prepared.

Manufacturing Example 9

The following components were mixed while agitated to prepare a milky liquid.

| | |
|---|---|
| Deionized water | 1000 |
| Fine particle dispersion (3) | 83 |
| Aqueous solution of sodium salt of dodecyl diphenyl ether disulfonic acid (ELEMINOL MON-7, manufactured by Sanyo Chemical Industries Ltd., solid content of 48.5%) | 37 |
| Ethyl acetate | 90 |

Thus, an aqueous phase liquid (6) was prepared.

Manufacturing Example 10

The following components were mixed while agitated to prepare a liquid.

| | |
|---|---|
| Deionized water | 1000 |
| Aqueous solution of sodium salt of dodecyl diphenyl ether disulfonic acid (ELEMINOL MON-7, manufactured by Sanyo Chemical Industries Ltd., solid content of 48.5%) | 40 |
| Ethyl acetate | 90 |

Thus, an aqueous phase liquid (7), which does not a particulate material, was prepared.

Synthesis of Polyester Resin Having Relatively Low Molecular Weight

Manufacturing Example 11

The following components were contained in a reaction container having a condenser, a stirrer and a nitrogen introducing tube and reacted for 8 hours at 230° C. under normal pressure.

| | |
|---|---|
| Adduct of 2 mole of ethylene oxide with bisphenol A | 229 |
| Adduct of 3 mole of propylene oxide with bisphenol A | 529 |
| Terephthalic acid | 208 |
| Adipic acid | 46 |
| Dibutyl tin oxide | 2 |

Then the reaction was further continued for 5 hours under a reduced pressure of from 10 to 15 mmHg. Further, 44 parts of trimellitic anhydride were added thereto to perform a reaction for 2 hours at 180° C. under a normal pressure. Thus, a polyester having a relatively low molecular weight (i.e., a second binder resin (1)) was prepared. The second binder resin (1) has a number average molecular weight of 2500, a weight average molecular weight of 6700, a Tg of 43° C., and an acid value of 25 mgKOH/g.

Manufacturing Example 12

The following components were contained in a reaction container having a condenser, a stirrer and a nitrogen introducing tube and reacted for 8 hours at 230° C. under a normal pressure.

| | |
|---|---|
| Adduct of 2 mole of ethylene oxide with bisphenol A | 262 |
| Adduct of 2 mole of propylene oxide with bisphenol A | 220 |
| Adduct of 3 mole of propylene oxide with bisphenol A | 236 |
| Terephthalic acid | 266 |
| Adipic acid | 48 |
| Dibutyl tin oxide | 2 |

Then the reaction was further continued for 5 hours under a reduced pressure of from 10 to 15 mmHg. Further, 34 parts of trimellitic anhydride were added thereto to perform a reaction for 2 hours at 180° C. under a normal pressure. Thus, a low molecular weight polyester (2) (a second binder resin (2)) was prepared. The second binder resin (2) has a number average molecular weight of 2390, a weight average molecular weight of 6010, a Tg of 62° C., and an acid value of 20.7 mgKOH/g.

Manufacturing Example 13

Synthesis of Prepolymer Having Isocyanate Group

The following components were contained in a reaction container having a condenser, a stirrer and a nitrogen introducing tube and reacted for 8 hours at 230° C. under a normal pressure.

| | |
|---|---|
| Adduct of 2 mole of ethylene oxide with bisphenol A | 682 |
| Adduct of 2 mole of propylene oxide with bisphenol A | 81 |
| Terephthalic acid | 283 |
| Trimellitic anhydride | 22 |
| Dibutyl tin oxide | 2 |

Then the reaction was further continued for 5 hours under a reduced pressure of from 10 to 15 mmHg. Thus, an intermediate polyester (1) was prepared. The intermediate polyester (1) has a number average molecular weight of 2100, a weight average molecular weight of 9500, a Tg of 55° C., an acid value of 0.5 mgKOH/g and a hydroxyl value of 51 mgKOH/g.

Then the following components were contained in a reaction container having a condenser, a stirrer and a nitrogen introducing tube and reacted for 5 hours at 100° C. to prepare a prepolymer (1).

| | |
|---|---|
| The intermediate polyester (1) | 410 |
| Isophorone diisocyanate | 89 |
| Ethyl acetate | 500 |

The prepolymer (1) included free isocyanate in an amount of 1.53% by weight.

Manufacturing Example 14

Preparation of Ketimine Compound

In a reaction container having a stirrer and a thermometer, 170 parts of isophorone diamine and 75 parts of methyl ethyl ketone were contained and reacted for 5 hours at 50° C. to prepare a ketimine compound (1). The ketimine compound (1) had an amine value of 418 mgKOH/g.

Manufacturing Example 15

Preparation of Master Batch

The following components were mixed with a HENSCHEL MIXER.

| | |
|---|---|
| Water | 1200 |
| Carbon black (PRINTEX 60, manufactured by Degussa A.G.) | 540 |
| The second binder resin (1) | 1200 |

The mixture was kneaded for 45 minutes at 130° C. by a two-roll mill and crushed by a pulverizer after cooling, to prepare a master batch (1) having a particle diameter of 1 mm.

The mixture was kneaded for 45 minutes at 130° C. by a two-roll mill and crushed by a pulverizer after cooling, to prepare a master batch (1) having a particle diameter of 1 mm.

Example 1

Preparation of Oil Phase Liquid

The following components were contained in a reaction container having a stirrer and a thermometer.

| | |
|---|---|
| The second binder resin (1) | 378 |
| Synthesized ester wax | 110 |
| Charge controlling agent (salicylic metal complex E-84, manufactured by Orient Chemical Industries Ltd.) | 22 |
| Ethyl acetate | 947 |

The mixture was heated to 80° C. while agitated. After the mixture was agitated at 80° C. for 5 hours, followed by cooling to 30° C. in an hour.

Next, 500 parts of the master batch (1) and 500 parts of ethyl acetate were added thereto and the mixture was mixed for 1 hour to prepare a material solution (1).

The material solution (1) of 1,324 parts was transferred to a container and was subjected to a dispersion treatment using a bead mill (ULTRA VISCO MILL, manufactured by Aimex Co., Ltd.) under the following condition.

Liquid feeding speed: 1 kg/hour

Disc rotating speed: 6 m/second

Beads: zirconia beads having a size of 0.5 mm were contained in the mill in an amount of 80% by volume based on the volume of the vessel Number of times of dispersion: 3 passes Next, 1324 parts of a 65% ethyl acetate solution of the second binder resin (1) were added thereto and the mixture was passed once through the bead mill under the above-mentioned conditions to prepare a pigment/wax dispersion (1). The solid content of the pigment/wax dispersion (1) was 50% when measured by heating the dispersion at 130° C. for 30 minutes.

Emulsification and Removal of Solvent

The following components were contained in a container.

| | |
|---|---|
| Pigment/wax dispersion (1) | 650 |
| Prepolymer (1) | 140 |
| Ketimine compound (1) | 6 |

The components were mixed by a TK HOMOMIXER (manufactured by Tokushu Kika Kogyo Co., Ltd.) at a speed of 5,000 rpm for 1 minute.

Then 1,200 parts of the aqueous phase (1) were added thereto to be mixed by the TK HOMOMIXER at a speed of 13,000 rpm for 20 minutes to prepare an emulsion slurry (1).

The emulsion slurry (1) was contained in a container having a stirrer and a thermometer to be subjected to a solvent removing treatment at 30° C. for 8 hours, followed by aging at 40° C. for 8 hours to prepare a dispersion slurry (1).

Washing and Drying

The dispersion slurry (1) of 100 parts was filtered under a reduced pressure. Then the following operations were performed to prepare a filter cake (1).

(1) 100 parts of ion-exchanged water were added to the cake obtained by filtering the dispersion slurry (1) and the mixture was mixed for 10 minutes by a TK HOMOMIXER at a speed of 12,000 rpm, followed by filtering to prepare a filtered cake (a).

(2) 100 parts of a 10% aqueous solution of sodium hydroxide were added to the filtered cake (a) and the mixture was mixed for 30 minutes by the TK HOMOMIXER at a speed of 12,000 rpm while applying ultrasonic vibration, followed by filtering under a reduced pressure. This ultrasonic alkali washing was repeated twice to prepare a filtered cake (b).

(3) 100 parts of a 10% aqueous solution of hydrochloric acid were added to the filter cake (b) and the mixture was mixed for 10 minutes by the TK HOMOMIXER at a speed of 12,000 rpm, followed by filtering to prepare a filtered cake (c).

(4) 300 parts of ion-exchanged water were added to the filtered cake (c) and the mixture was mixed for 10 minutes by the TK HOMO MIXER at a speed of 12,000 rpm, followed by filtering. This operation was performed twice to prepare the filtered cake (1).

The filter cake (1) was dried by an air dryer at 45° C. for 48 hours, followed by sifting with a screen having 75 μm openings to prepare a toner (1) (i.e., toner particles).

The photographs of particles of the toner (1) taken by a scanning electron microscope are shown in FIGS. 1A and 1B.

The photograph in FIG. 1A was taken with a magnification of 13,000. The photograph in FIG. 1B was taken with a magnification of 50,000. As can be understood from the photographs, a fine particulate vinyl resin is present on the surface of the toner particles while embedded thereinto.

The toner (1) has a volume average particle diameter of 5.43 μm, and a Tg of 46° C. In addition, the content of the THF-insoluble components in the binder resin of the toner (1) was 12%.

Five (5) parts of the toner was mixed with 95 parts of a carrier which had been prepared by coating a magnetite powder having an average particle diameter of 35 μm with a coating liquid including the following components to prepare a developer.

| | |
|---|---|
| Methyl methacrylate resin | 35 |
| Silicone resin | 60 |
| Carbon black (KETJEN BLACK) | 5 |

The thus prepared developer was subjected to an image forming test to evaluate the fixability, offset resistance, transferability and preservability of the toner. The evaluation methods are described below. With respect to the fixability, the evaluation method (a) was used for the toners prepared in Examples 1 to 5; and the evaluation method (b) was used for the toner prepared in Example 5.

The results are shown in Table 1. As a result, the toner (1) had a good combination of low temperature fixability, offset resistance, preservability and transferability.

Evaluation Method

Particle Diameter of Toner

The particle diameter (i.e., volume average particle diameter and number average particle diameter) of a toner was measured with a particle diameter measuring instrument, COULTER COUNTER TAII, manufactured by Coulter Electronics, Inc., which is equipped with an aperture having a diameter of 100 μm.

Fixability (a) Each developer was set in a copier, IMAGIO NEO 450, which can produce 45 copies of A4 size per minute, and black solid images were continuously produced on a plain paper (TYPE 6200 paper from Ricoh Co., Ltd.) and a thick paper (COPY/PRINT PAPER 135 from NBS Ricoh) while the developing conditions were controlled such that the weight of the solid toner image is 1.0±0.1 mg/cm$^2$.

In addition, the temperature of the fixing roller was changed to determine the offset temperature (when the plain paper was used) and the minimum fixable temperature (when the thick paper was used). The minimum fixable temperature was defined as the lowest fixing temperature of the fixing roller in a fixing temperature range in which when a fixed image was rubbed with a pad, the image has an image density not lower than 70% of the original image density.

(b) The procedure for evaluation in paragraph (a) was repeated except that the fixing device of IMAGIO NEO 450 was replaced with the fixing device illustrated in FIG. 3.

In this case, the fixing belt (B) includes a polyimide substrate having a thickness of 100 μm; an intermediate elastic layer which is located on the substrate and is made of a silicone rubber and which has a thickness of 100 μm; and an offset preventing layer which is located as an outermost layer and is made of a perfluroalkoxyethylene copolymer (PFA) and which has a thickness of 15 μm. The fixing roller R1 is made of a foamed silicone resin. The pressure roller R2 includes a metal cylinder which is made of a stainless steel (SUS) and has a thickness of 1 mm; and an offset preventing layer which is a combination of a PFA tube; and a silicone rubber layer and which has a thickness of 2 mm. The heat roller R3 is made of an aluminum cylinder having a thickness of 2 mm, and the pressure of the heat roller R3 applied to the fixing belt (B) is $1\times10^5$ Pa.

Transferability

Images were produced in the same way as performed in the evaluation of the fixability. When a toner image formed on the photoreceptor was transferred to a receiving material, the copier was suddenly turned off to visually determine the amount of toner remaining on an area of the photoreceptor, from which toner image had been transferred to the receiving material The transferability of the toners is classified into the following four grades:

◎: the amount of residual toner is very little, i.e., the toner has excellent transferability.

○: the amount of residual toner is little, i.e., the toner has good transferability.

Δ: the toner has a transferability almost the same as those of conventional toners.

X: the amount of residual toner is very large, i.e., the toner has poor transferability.

Preservability

Ten (10) grams of a toner was contained in a container of 30 ml. The container was tapped 150 times to condense the toner. The container including the toner was preserved for 24 hours in a chamber in which the temperature was controlled at 50° C. Then the container was cooled to room temperature. The toner was sifted using a screen having openings of 74 μm, and the weight of the toner remaining on the screen was measured. The preservability of the toners is classified into the following four grades:

◎: there is no toner remaining on the screen.

○: the weight of the toner remaining on the screen is less than 1 g.

Δ: the weight of the toner remaining on the screen is not less than 1 g and less than 4 g.

X: the weight of the toner remaining on the screen is not less than 4 g

Example 2

Preparation of Toner

The procedure for preparation and evaluation of the toner (1) in Example 1 was repeated except that the aqueous phase liquid (1) was replaced with the aqueous phase liquid (3) that includes a silica.

The thus prepared toner had a volume average particle diameter of 4.76 μm, and a Tg of 48° C. In addition, the content of the THF-insoluble components of the binder resin in the toner was 11%.

As can be understood from the results as shown in Table 1, the toner has a good combination of low temperature fixability, offset resistance, preservability and transferability.

Example 3

Preparation of Toner

The procedure for preparation and evaluation of the toner (1) in Example 1 was repeated except that the aqueous phase liquid (1) was replaced with the aqueous phase liquid (4) that includes a titanium dioxide.

The thus prepared toner had a volume average particle diameter of 5.14 μm, and a Tg of 47° C. In addition, the content of the THF-insoluble components of the binder resin in the toner was 12%.

As can be understood from the results as shown in Table 1, the toner has a good combination of low temperature fixability, offset resistance, preservability and transferability.

Example 4

Preparation of Toner

The procedure for preparation and evaluation of the toner (1) in Example 1 was repeated except that the aqueous phase liquid (1) was replaced with the aqueous phase liquid (5) that includes a particulate resin and a titanium dioxide.

The thus prepared toner had a volume average particle diameter of 5.22 μm, and a Tg of 47° C. In addition, the content of the THF-insoluble components of the binder resin in the toner was 12%.

As can be understood from the results as shown in Table 1, the toner has a good combination of low temperature fixability, offset resistance, preservability and transferability.

Example 5

Preparation of Toner

The procedure for preparation and evaluation of the toner (1) in Example 1 was repeated except that the aqueous phase liquid (1) was replaced with the aqueous phase liquid (2) that includes a particulate resin.

The thus prepared toner had a volume average particle diameter of 5.51 μm, and a Tg of 48° C. In addition, the content of the THF-insoluble components of the binder resin in the toner was 12%.

As can be understood from the results as shown in Table 1, the toner has a good combination of low temperature fixability, offset resistance, preservability and transferability. In particular, the toner has excellent low temperature fixability, offset resistance and preservability.

Example 6

Preparation of Toner

The procedure for preparation and evaluation of the toner in Example 5 was repeated except that the method (b) was used for evaluating the fixability of the toner.

Since the toner has good low temperature fixability so that the fixing temperature can be decreased and in addition temperature rising time can be reduced, and thereby fixing energy can be dramatically saved.

Comparative Example 1

Preparation of Toner

The procedure for preparation and evaluation of the toner (1) in Example 1 was repeated except that the aqueous phase liquid (1) was replaced with the aqueous phase liquid (7) that includes no particulate resin.

The thus prepared toner had a volume average particle diameter of 6.85 μm, and a Tg of 45° C. In addition, the content of the THF-insoluble components of the binder resin in the toner was 13%.

As can be understood from the results as shown in Table 1, the toner has a good low temperature fixability, but the toner has poor offset resistance, preservability and transferability.

Comparative Example 2

Preparation of Toner

The procedure for preparation and evaluation of the toner (1) in Example 1 was repeated except that the aqueous phase liquid (1) was replaced with the aqueous phase liquid (6) that includes a particulate resin having a Tg of 150° C.

The thus prepared toner had a volume average particle diameter of 5.43 μm, and a Tg of 49° C. In addition, the content of the THF-insoluble components of the binder resin in the toner was 11%.

As can be understood from the results as shown in Table 1, the toner has a good preservability, but the toner has a high minimum fixing temperature (i.e., has a poor fixability).

Comparative Example 3

Preparation of Toner

The procedure for preparation and evaluation of the toner (1) in Example 1 was repeated except that the second binder resin (1) was replaced with the second binder resin (2) having a Tg of 62° C.

The thus prepared toner had a volume average particle diameter of 5.81 μm, and a Tg of 61.3° C. In addition, the content of the THF-insoluble components of the binder resin of the toner was 12%.

As can be understood from the results as shown in Table 1, the toner has a good preservability, but the toner has a high minimum fixing temperature (i.e., has a poor fixability).

Comparative Example 4

Preparation of Toner

The procedure for preparation and evaluation of the toner (1) in Example 1 was repeated except that when the emulsion slurry was prepared, the prepolymer (1) and the ketimine compound were replaced with 146 parts of the second binder resin (1).

The thus prepared toner had a volume average particle diameter of 3.78 μm, and a Tg of 44.2° C. In addition, the content of the THF-insoluble components of the binder resin of the toner was 0%.

As can be understood from the results as shown in Table 1, the toner has a good low temperature fixability, but the toner has a slightly poor offset resistance. In addition, the preservability and transferability of the toner were slightly deteriorated.

Comparative Example 5

Preparation of Toner

The procedure for preparation and evaluation of the toner (1) in Example 1 was repeated except that when the emulsion slurry was prepared, the addition amounts of the pigment/wax dispersion (1), the prepolymer (1) and the ketimine compound (1) were changed to 800 parts, 280 parts and 12.0 parts, respectively.

The thus prepared toner had a volume average particle diameter of 6.39 μm, and a Tg of 49.4° C. In addition, the content of the THF-insoluble components of the binder resin in the toner was 23%.

As can be understood from the results as shown in Table 1, the toner has an excellent offset resistance, but the toner has poor low temperature fixability.

TABLE 1

| | Minimum fixable temperature (° C.) | Hot offset temperature (° C.) | Preservability | Transferability |
|---|---|---|---|---|
| Ex. 1 | 135 | 230 | ○ | ○ |
| Ex. 2 | 135 | 235 | ○ | ○ |
| Ex. 3 | 135 | 235 | ○ | ○ |
| Ex. 4 | 135 | 230 | ○ | ○ |
| Ex. 5 | 125 | Not lower than 240 | ◎ | ○ |
| Ex. 6 | 110 | 230 | ◎ | ○ |
| Comp. Ex. 1 | 120 | 180 | X | X |
| Comp. Ex. 2 | 155 | 240 | ◎ | ○ |
| Comp. Ex. 3 | 150 | 240 | ◎ | ○ |
| Comp. Ex. 4 | 125 | 160 | Δ | Δ |
| Comp. Ex. 5 | 160 | Not lower than 240 | ○ | ○ |

Manufacturing Example 16

Preparation of Particulate Resin Emulsion

The following components were contained in a reaction container having a stirrer and a thermometer and agitated for 15 minutes by a stirrer at a speed of 400 rpm to prepare a white emulsion.

| | |
|---|---|
| Water | 683 |
| Sodium salt of sulfate of ethylene oxide adduct of methacrylic acid (ELEMINOL RS-30, manufactured by Sanyo Chemical Industries Ltd.) | 11 |
| Styrene | 83 |
| Methacrylic acid | 83 |
| Butyl acrylate | 110 |
| Ammonium persulfate | 1 |

The emulsion was heated to 75° C. to perform a reaction for 5 hours.

Further, 30 parts of a 1% aqueous solution of ammonium persulfate were added thereto and the mixture was aged at 75° C. for 5 hours to prepare an aqueous dispersion of a vinyl resin (styrene-methacrylic acid-butyl acrylate-sodium salt of sulfate of ethylene oxide adduct of methacrylic acid copolymer. The volume average particle diameter of the thus prepared fine particle dispersion (11) was 105 nm when measured with a particle diameter measuring instrument LA-920. A part of the fine particle dispersion (11) was dried to isolate the resin component. The glass transition temperature (Tg) and the weight average molecular weight of the resin component were 59° C. and 150,000, respectively.

Manufacturing Example 17

Preparation of Aqueous Phase Liquid

The following components were mixed while agitated to prepare a milky liquid.

| | |
|---|---|
| Deionized water | 990 |
| Fine particle dispersion (11) | 83 |
| Aqueous solution of sodium salt of dodecyl diphenyl ether disulfonic acid (ELEMINOL MON-7, manufactured by Sanyo Chemical Industries Ltd., solid content of 48.5%) | 37 |
| Ethyl acetate | 90 |

Thus, an aqueous phase liquid (11) was prepared.

Manufacturing Example 18

Synthesis of Second Binder Resin

The following components were contained in a reaction container having a condenser, a stirrer and a nitrogen introducing tube and reacted for 8 hours at 230° C. under a normal pressure.

| | |
|---|---|
| Adduct of 2 mole of ethylene oxide with bisphenol A | 229 |
| Adduct of 3 mole of propylene oxide with bisphenol A | 529 |
| Terephthalic acid | 208 |
| Adipic acid | 46 |
| Dibutyl tin oxide | 2 |

Then the reaction was further continued for 5 hours under a reduced pressure of from 10 to 15 mmHg. Further, 44 parts of trimellitic anhydride were added thereto to perform a reaction for 2 hours at 180° C. under a normal pressure. Thus, a second binder resin (11) was prepared. The second binder resin (11) has a number average molecular weight of 2500, a weight average molecular weight of 6700, a Tg of 43° C., and an acid value of 25 mgKOH/g.

Manufacturing Example 19

Synthesis of Intermediate Polyester for Prepolymer Having Isocyanate Group

The following components were contained in a reaction container having a condenser, a stirrer and a nitrogen introducing tube and reacted for 8 hours at 230° C. under a normal pressure.

| | |
|---|---|
| Adduct of 2 mole of ethylene oxide with bisphenol A | 682 |
| Adduct of 2 mole of propylene oxide with bisphenol A | 81 |
| Terephthalic acid | 283 |
| Trimellitic anhyderide | 22 |
| Dibutyl tin oxide | 2 |

Then the reaction was further continued for 5 hours under a reduced pressure of from 10 to 15 mmHg. Thus, an intermediate polyester (11) was prepared. The intermediate polyester (11) has a number average molecular weight of 2100, a weight average molecular weight of 9500, a Tg of 55° C., an acid value of 0.5 mgKOH/g and a hydroxyl value of 51 mgKOH/g.

Then the following components were contained in a reaction container having a condenser, a stirrer and a nitrogen introducing tube and reacted for 5 hours at 100° C. to prepare a prepolymer (11).

| | |
|---|---|
| The intermediate polyester (11) | 410 |
| Isophorone diisocyanate | 89 |
| Ethyl acetate | 500 |

The prepolymer (11) included free isocyanate in an amount of 1.53% by weight.

Manufacturing Example 20

Preparation of Ketimine Compound

In a reaction container having a stirrer and a thermometer, 170 parts of isophorone diamine and 75 parts of methyl ethyl ketone were contained and reacted for 5 hours at 50° C. to prepare a ketimine compound (11). The ketimine compound (11) had an amine value of 418 mgKOH/g.

Manufacturing Example 21

Preparation of Master Batch

The following components were mixed with a Henshel mixer.

| | |
|---|---|
| Water | 1200 |
| Carbon black (PRINTEX 35, manufactured by Degussa A.G., oil absorption of 42 g/100 g, and pH of 9.5) | 540 |
| Polyester resin | 1200 |

The mixture was kneaded for 30 minutes at 150° C. by a two-roll mill and crushed by a pulverizer after cooling to prepare a master batch (11).

Manufacturing Example 22

Preparation of Oil Phase

The following components were contained in a reaction container having a stirrer and a thermometer.

| | |
|---|---|
| The second binder resin (11) | 378 |
| Carnauba wax | 110 |
| Charge controlling agent (salicylic metal complex E-84, manufactured by Orient Chemical Industries Ltd.) | 22 |
| Ethyl acetate | 947 |

The mixture was heated to 80° C. while agitated. After the mixture was agitated at 80° C. for 5 hours, the mixture was cooled to 30° C. in an hour.

Next, 500 parts of the master batch (11) and 500 parts of ethyl acetate were added thereto and the mixture was mixed for 1 hour to prepare a material solution (11).

The material solution (11) of 1,324 parts was transferred to a container and was subjected to a dispersion treatment using a bead mill (ULTRA VISCO MILL, manufactured by Aimex Co., Ltd.) under the following condition.

Liquid feeding speed: 1 kg/hour

Disc rotating speed: 6 m/second

Beads: zirconia beads having a size of 0.5 mm were contained in the mill in an amount of 80% by volume based on the volume of the vessel Number of times of dispersion: 3 times (i.e., 3 passes)

Next, 1324 parts of a 65% ethyl acetate solution of the second binder resin (11) were added thereto and the mixture was passed once through the bead mill under the above-mentioned conditions to prepare a pigment/wax dispersion (11). The solid content of the pigment/wax dispersion (11) was 50% when measured by heating the dispersion at 130° C. for 30 minutes.

Example 7

Preparation of Toner

Emulsification and Removal of Solvent

The following components were contained in a container.

| | |
|---|---|
| Pigment/wax dispersion (11) | 749 |
| Prepolymer (11) | 115 |
| Ketimine compound (11) | 2.9 |

The components were mixed by a TK HOMOMIXER (manufactured by Tokushu Kika Kogyo Co., Ltd.) at a speed of 5,000 rpm for 1 minute.

Then 1,200 parts of the aqueous phase liquid (11) were added thereto to be mixed by the TK HOMOMIXER at a speed of 13,000 rpm for 20 minutes to prepare an emulsion slurry (11).

The emulsion slurry (11) was contained in a container having a stirrer and a thermometer to be subjected to a solvent removing treatment at 30° C. for 8 hours, followed by aging at 45° C. for 4 hours to prepare a dispersion slurry (11). The weight average particle diameter and number average particle diameter of the dispersion slurry (11) were 5.99 μm and 5.70 μm, respectively when measured by MULTISIZER II manufactured by Coulter Electronics, Inc.

Washing and Drying

The dispersion slurry (11) of 100 parts was filtered under a reduced pressure. Then the following operations were performed to prepare a filter cake (11).

(1) 100 parts of ion-exchanged water were added to the cake obtained by filtering the dispersion slurry (11) and the mixture was mixed for 10 minutes by a TK HOMOMIXER at a speed of 12,000 rpm, followed by filtering to prepare a filtered cake (a2).

(2) 100 parts of a 10% aqueous solution of sodium hydroxide were added to the filtered cake (a2) and the mixture was mixed for 30 minutes by the TK HOMOMIXER at a speed of 12,000 rpm while applying ultrasonic vibration, followed by filtering under a reduced pressure. This ultrasonic alkali washing was repeated twice to prepare a filtered cake (b2).

(3) 100 parts of a 10% aqueous solution of hydrochloric acid were added to the filter cake (b2) and the mixture was mixed for 10 minutes by the TK HOMOMIXER at a speed of 12,000 rpm, followed by filtering to prepare a filtered cake (c2).

(4) 300 parts of ion-exchanged water were added to the filtered cake (c2) and the mixture was mixed for 10 minutes by the TK HOMOMIXER at a speed of 12,000 rpm, followed by filtering. This operation was performed twice to prepare the filtered cake (11).

The filter cake (11) was dried by an air dryer at 45° C. for 48 hours, followed by sifting with a screen having 75 μm openings to prepare a particulate toner (11) (i.e., toner particles).]

Manufacturing Example 23

Preparation of Particulate Resin Emulsion

The following components were contained in a reaction container having a stirrer and a thermometer and agitated for 15 minutes by a stirrer at a speed of 400 rpm to prepare a white emulsion.

| | |
|---|---|
| Water | 683 |
| Sodium salt of sulfate of ethylene oxide adduct of methacrylic acid (ELEMINOL RS-30, manufactured by Sanyo Chemical Industries Ltd.) | 11 |
| Styrene | 80 |
| Methacrylic acid | 83 |
| Butyl acrylate | 110 |
| Butyl thioglycolate | 12 |
| Ammonium persulfate | 1 |

The emulsion was heated to 75° C. to perform a reaction for 5 hours.

Further, 30 parts of a 1% aqueous solution of ammonium persulfate were added thereto and the mixture was aged at 75° C. for 5 hours to prepare an aqueous dispersion of a vinyl resin (styrene-methacrylic acid-butyl acrylate-sodium salt of sulfate of ethylene oxide adduct of methacrylic acid copolymer) The volume average particle diameter of the thus prepared fine particle dispersion (12) was 120 nm when measured with a particle diameter measuring instrument LA-920. A part of the fine particle dispersion (12) was dried to isolate the resin component. The glass transition temperature (Tg) and the weight average molecular weight of the resin component were 42° C. and 30,000, respectively.

Example 8

Preparation of Toner

The procedure for preparation of the toner (11) in Example 7 was repeated except that the fine particle dispersion (11) was replaced with the fine particle dispersion (12). Thus, a toner (12) was prepared.

Manufacturing Example 24

Preparation of Particulate Resin Emulsion

The following components were contained in a reaction container having a stirrer and a thermometer and agitated for 15 minutes by a stirrer at a speed of 400 rpm to prepare a white emulsion.

| | |
|---|---|
| Water | 683 |
| Sodium salt of sulfate of ethylene oxide adduct of methacrylic acid (ELEMINOL RS-30, manufactured by Sanyo Chemical Industries Ltd.) | 11 |
| Styrene | 103 |
| Methacrylic acid | 83 |
| Butyl acrylate | 90 |
| Butyl thioglycolate | 12 |
| Ammonium persulfate | 1 |

The emulsion was heated to 75° C. to perform a reaction for 5 hours.

Further, 30 parts of a 1% aqueous solution of ammonium persulfate were added thereto and the mixture was aged at 75° C. for 5 hours to prepare an aqueous dispersion of a vinyl resin (styrene-methacrylic acid-butyl acrylate-sodium salt of sulfate of ethylene oxide adduct of methacrylic acid copolymer). The volume average particle diameter of the thus prepared fine particle dispersion (13) was 110 nm when measured with a particle diameter measuring instrument LA-920. A part of the fine particle dispersion (13) was dried to isolate the resin component. The glass transition temperature (Tg) and the weight average molecular weight of the resin component were 78° C. and 25,000, respectively.

Example 9

Preparation of Toner

The procedure for preparation of the toner (11) in Example 257 was repeated except that the fine particle dispersion (11) was replaced with the fine particle dispersion (13). Thus, a toner (13) was prepared.

Manufacturing Example 25

Preparation of Particulate Resin Emulsion

The following components were contained in a reaction container having a stirrer and a thermometer and agitated for 15 minutes by a stirrer at a speed of 400 rpm to prepare a white emulsion.

| | |
|---|---|
| Water | 683 |
| Sodium salt of sulfate of ethylene oxide adduct of methacrylic acid (ELEMINOL RS-30, manufactured by Sanyo Chemical Industries Ltd.) | 11 |
| Styrene | 78 |
| Methacrylic acid | 83 |
| Butyl acrylate | 115 |
| Butyl thioglycolate | 2 |
| Ammonium persulfate | 1 |

The emulsion was heated to 75° C. to perform a reaction for 5 hours.

Further, 30 parts of a 1% aqueous solution of ammonium persulfate were added thereto and the mixture was aged at 75° C. for 5 hours to prepare an aqueous dispersion of a vinyl resin (styrene-methacrylic acid-butyl acrylate-sodium salt of sulfate of ethylene oxide adduct of methacrylic acid copolymer). The volume average particle diameter of the thus prepared fine particle dispersion (14) was 115 nm when measured with a particle diameter measuring instrument LA-920. A part of the fine particle dispersion (14) was dried to isolate the resin component. The glass transition temperature (Tg) and the weight average molecular weight of the resin component were 51° C. and 100,000, respectively.

Example 10

Preparation of Toner

The procedure for preparation of the toner (11) in Example 7 was repeated except that the fine particle dispersion (11) was replaced with the fine particle dispersion (14). Thus, a toner (14) was prepared.

Manufacturing Example 26

Preparation of Particulate Resin Emulsion

The following components were contained in a reaction container having a stirrer and a thermometer and agitated for 15 minutes by a stirrer at a speed of 400 rpm to prepare a white emulsion.

| | |
|---|---|
| Water | 683 |
| Sodium salt of sulfate of ethylene oxide adduct of methacrylic acid (ELEMINOL RS-30, manufactured by Sanyo Chemical Industries Ltd.) | 11 |
| Styrene | 68 |
| Methacrylic acid | 93 |
| Butyl acrylate | 115 |
| Ammonium persulfate | 1 |

The emulsion was heated to 75° C. to perform a reaction for 5 hours.

Further, 30 parts of a 1% aqueous solution of ammonium persulfate were added thereto and the mixture was aged at 75° C. for 5 hours to prepare an aqueous dispersion of a vinyl resin (styrene-methacrylic acid-butyl acrylate-sodium salt of sulfate of ethylene oxide adduct of methacrylic acid copolymer) The volume average particle diameter of the thus prepared fine particle dispersion (15) was 90 nm when measured with a particle diameter measuring instrument LA-920. A part of the fine particle dispersion (15) was dried to isolate the resin component. The glass transition temperature (Tg) and the weight average molecular weight of the resin component were 56° C. and 150,000, respectively.

Example 11

Preparation of Toner

The procedure for preparation of the toner (11) in Example 7 was repeated except that the fine particle dispersion (11) was replaced with the fine particle dispersion (15). Thus, a toner (15) was prepared.

Manufacturing Example 27

Preparation of Emulsion Slurry

The following components were contained in a container.

| | |
|---|---|
| Pigment/wax dispersion (11) | 753 |
| Prepolymer (11) | 154 |
| Ketimine compound (11) | 3.8 |

The components were mixed by a TK HOMOMIXER (manufactured by Tokushu Kika Kogyo Co., Ltd.) at a speed of 5,000 rpm for 1 minute.

Then 1,200 parts of the aqueous phase (11) were added thereto to be mixed by the TK HOMOMIXER at a speed of 13,000 rpm for 20 minutes to prepare an emulsion slurry (12).

Example 12

Preparation of Toner

The procedure for preparation of the toner (15) in Example 11 was repeated except that the emulsion slurry (11) was replaced with the emulsion slurry (12). Thus, a toner (16) was prepared.

Manufacturing Example 28

Synthesis of Second Binder Resin

The following components were contained in a reaction container having a condenser, a stirrer and a nitrogen introducing tube and reacted for 8 hours at 230° C. under a normal pressure.

| | |
|---|---|
| Adduct of 2 mole of ethylene oxide with bisphenol A | 553 |
| Adduct of 2 mole of propylene oxide with bisphenol A | 196 |
| Terephthalic acid | 210 |
| Adipic acid | 79 |
| Dibutyl tin oxide | 2 |

Then the reaction was further continued for 5 hours under a reduced pressure of from 10 to 15 mmHg. Further, 26 parts of trimellitic anhydride were added thereto to perform a reaction for 2 hours at 180° C. under a normal pressure. Thus, a second binder resin (12) was prepared. The second binder resin (12) has a number average molecular weight of 2400, a weight average molecular weight of 6200, a Tg of 43° C., and an acid value of 15 mgKOH/g.

Example 13

Preparation of Toner

The procedure for preparation of the toner (15) in Example 11 was repeated except that the second binder resin (11) was replaced with the second binder resin (12). Thus, a toner (17) was prepared.

Comparative Example 6

Preparation of Toner

In a container, 709 parts of deionized water and 451 parts of a 0.1 mole aqueous solution of $Na_3PO_4$ were mixed. After the mixture was heated to 60° C., the mixture was agitated with a TK HOMOMIXER at a speed of 12,000 rpm. Then 68 parts of a 1.0 mole aqueous solution of $CaCl_2$ were gradually added thereto to prepare an aqueous medium including $Ca_3(PO_4)_2$. Then 170 parts of styrene, 30 parts of 2-ethylhexyl acrylate, 10 parts of a carbon black (REGAL 400R from Cabot Corp.), 60 parts of a paraffin wax having a softening point of 70° C., 5 parts of a metal compound of di-tert-butyl salicylate and 10 parts of a styrene-methacrylic acid copolymer having a weight average molecular weight of 50,000 and an acid value of 20 mgKOH/g were mixed in a container and the mixture was heated to 60° C. Then the mixture was agitated with a TK HOMOMIXER at a speed of 12,000 rpm to be uniformly dissolved and dispersed. Then 10 parts of a polymerization initiator, 2,2'-azobis(2,4-dimethylvaleronitrile) were dissolved therein. Thus, a polymerizable liquid was prepared.

This polymerizable liquid was added to the above-prepared aqueous medium and the mixture was agitated for 20 minutes at 60° C. using a TK HOMOMIXER at a speed of 10,000 rpm under a nitrogen atmosphere. The thus prepared polymerizable monomer particle dispersion was reacted for 3 hours at 60° C. while agitated with a paddle agitator. Then the liquid was heated to 80° C. and further reacted for 10 hours.

After completion of the reaction, the liquid was cooled and hydrochloric acid was added thereto to dissolve calcium phosphate. Then the liquid was filtered and the cake was washed and dried. Thus, a toner (18) was prepared.

Manufacturing Example 29

Preparation of Wax Dispersion

In a 1000 ml four-neck flask equipped with a stirrer, a thermosensor, a condenser and a nitrogen introducing pipe, 500 ml of distilled water which had been degassed, 28.5 g of a nonionic surfactant NEWCALL 565C (manufactured by Nippon Emulsifier Co., Ltd.), and 185.5 g of CANDELILLA WAX No. 1 (manufactured by Noda Wax Co., Ltd.) were mixed. The mixture was heated under a nitrogen gas flow. When the temperature of the inside of the flask reached 85° C., a 5N aqueous solution of sodium hydroxide was added thereto, and the temperature was maintained at 75° C. The mixture was agitated for 1 hour while the temperature was maintained. Then the liquid was cooled to room temperature. Thus, an aqueous wax dispersion (1) was prepared.

Manufacturing Example 30

Preparation of Aqueous Colorant Dispersion

One hundred (100) grams of a carbon black (MOGAL L from Cabot Corp.) and 25 g of sodium dodecylsulfate were added to 540 ml of distilled water. After being agitated, the mixture was dispersed using a pressure dispersing machine (MINI-LAB from Larney Corp.). Thus an aqueous colorant dispersion (1) was prepared.

Manufacturing Example 31

Preparation of Aqueous Binder Particle Dispersion

In a 1000 ml four-neck flask equipped with a stirrer, a thermosensor, a condenser and a nitrogen introducing pipe, 480 ml of distilled water, 0.6 g of sodium dodecylsulfate, 106. 4 g of styrene, 43.2 g of n-butyl acrylate and 10.4 g of methacrylic acid were mixed and heated to 70° C. while agitated under a nitrogen gas flow. An aqueous initiator solution which had been prepared by dissolving 2.1 g of potassium persulfate in 120 ml of distilled water was added thereto, and the mixture was agitated for 3 hours at 70° C. under a nitrogen gas flow. After completion of the reaction, the liquid was cooled to room temperature. Thus, a high molecular weight binder dispersion (1) was prepared.

In a 5000 ml four-neck flask equipped with a stirrer, a thermosensor, a condenser and a nitrogen introducing pipe, 2400 ml of distilled water, 2.8 g of sodium dodecylsulfate, 620 g of styrene, 128 g of n-butyl acrylate, 52 g of methacrylic acid and 27.4 g of tert-dodecyl mercaptan were contained and heated to 70° C. while agitated under a nitrogen gas flow. An aqueous initiator solution which had been prepared by dissolving 11.2 g of potassium persulfate in 600 ml of distilled water was added thereto, and the mixture was agitated for 3 hours at 70° C. under a nitrogen gas flow. After completion of the reaction, the liquid was cooled to room temperature. Thus, a low molecular weight binder dispersion (1) was prepared.

Comparative Example 7

Preparation of Toner

In a 1000 ml separable flask equipped with a stirrer, a thermosensor, a condenser and a nitrogen introducing pipe, 47.6 g of the high molecular weight binder dispersion (1) and 190.5 g of the low molecular weight binder dispersion (1), 7.7 g of the aqueous wax dispersion (1), 26.7 g of the aqueous colorant dispersion (1) and 252.5 ml of distilled water were contained and agitated to be mixed. Then a 5N aqueous solution of sodium hydroxide was added thereto to control the pH of the mixture at 9.5. Then an aqueous solution of sodium chloride which had been prepared by dissolving 50 g of sodium chloride in 600 ml of distilled water, 77 ml of isopropanol, and an aqueous solution of a surfactant which had been prepared by dissolving 10 mg of a fluorine-containing nonion surfactant FLUORARD FC-170C from Sumitomo 3M Ltd. in 10 ml of distilled water were added thereto in this order. The mixture was heated such that the temperature of the inside of the flask was 85° C. to perform a reaction for 6 hours. Then the reaction product was cooled to room temperature and the pH thereof was adjusted so as to be 13 using a 5N aqueous solution of sodium hydroxide. Then the reaction product was filtered and the cake was re-suspended in distilled water. The suspension was then filtered. This washing treatment was repeated and then the cake was dried. Thus, a toner (19) was prepared.

Manufacturing Example 32

Preparation of Particulate Resin Emulsion

The following components were contained in a reaction container having a stirrer and a thermometer and agitated for 15 minutes by a stirrer at a speed of 400 rpm to prepare a white emulsion.

| | |
|---|---|
| Water | 683 |
| Sodium salt of sulfate of ethylene oxide adduct of methacrylic acid (ELEMINOL RS-30, manufactured by Sanyo Chemical Industries Ltd.) | 11 |
| Styrene | 138 |
| Methacrylic acid | 138 |
| Ammonium persulfate | 1 |

The emulsion was heated to 75° C. to perform a reaction for 5 hours.

Further, 30 parts of a 1% aqueous solution of ammonium persulfate were added thereto and the mixture was aged at 75° C. for 5 hours to prepare an aqueous dispersion of a vinyl resin (styrene-methacrylic acid-butyl acrylate-sodium salt of sulfate of ethylene oxide adduct of methacrylic acid copolymer. The volume average particle diameter of the thus prepared fine particle dispersion (16) was 140 nm when measured with a particle diameter measuring instrument LA-920. A part of the fine particle dispersion (16) was dried to isolate the resin component. The glass transition temperature (Tg) and the weight average molecular weight of the resin component were 152° C. and 400,000, respectively.

Comparative Example 8

Preparation of Toner

The procedure for preparation of the toner (11) in Example 7 was repeated except that the fine particle dispersion (11) was replaced with the fine particle dispersion (16). Thus, a toner 20 was prepared.

Manufacturing Example 33

Preparation of Particulate Resin Emulsion

The following components were contained in a reaction container having a stirrer and a thermometer and agitated for 15 minutes by a stirrer at a speed of 400 rpm to prepare a white emulsion.

| | |
|---|---|
| Water | 683 |
| Sodium salt of sulfate of ethylene oxide adduct of methacrylic acid (ELEMINOL RS-30, manufactured by Sanyo Chemical Industries Ltd.) | 11 |
| Styrene | 63 |
| Methacrylic acid | 83 |
| Butyl acrylate | 130 |
| Butyl thioglycolate | 12 |
| Ammonium persulfate | 1 |

The emulsion was heated to 75° C. to perform a reaction for 5 hours.

Further, 30 parts of a 1% aqueous solution of ammonium persulfate were added thereto and the mixture was aged at 75° C. for 5 hours to prepare an aqueous dispersion of a vinyl resin (styrene-methacrylic acid-butyl acrylate-sodium salt of sulfate of ethylene oxide adduct of methacrylic acid copolymer). The volume average particle diameter of the thus prepared fine particle dispersion (17) was 130 nm when measured with a particle diameter measuring instrument LA-920. A part of the fine particle dispersion (17) was dried to isolate the resin component. The glass transition temperature (Tg) and the weight average molecular weight of the resin component were 30° C. and 5,000, respectively.

Comparative Example 9

Preparation of Toner

The procedure for preparation of the toner (11) in Example 7 was repeated except that the fine particle dispersion (11) was replaced with the fine particle dispersion (17). Thus, a toner (21) was prepared.

Manufacturing Example 34

Preparation of Aqueous Phase Liquid

The following components were mixed while agitated to prepare a milky liquid.

| | |
|---|---|
| Deionized water | 990 |
| Fine particle dispersion (11) | 4 |
| Aqueous solution of sodium salt of dodecyl diphenyl ether disulfonic acid (ELEMINOL MON-7, manufactured by Sanyo Chemical Industries Ltd., solid content of 48.5%) | 74 |
| Ethyl acetate | 90 |

Thus, an aqueous phase liquid (12) was prepared.

Comparative Example 10

Preparation of Toner

The procedure for preparation of the toner (11) in Example 7 was repeated except that the aqueous phase liquid (11) was replaced with the aqueous phase liquid (12). Thus, a toner (22) was prepared.

Comparative Example 11

Preparation of Toner

The procedure for preparation of the toner (11) in Example 7 was repeated except that the 10% aqueous solution of sodium hydrooxide was not added in the washing process. Thus, a toner (23) was prepared.

Evaluation

The glass transition temperature, weight average molecular weight, and average particle diameter of the particulate resins used in each examples and comparative examples are shown in Table 2.

One hundred (100) parts of each toner were mixed with 0.7 parts of a hydrophobic silica and 0.3 parts of a hydrophobic titanium oxide using a HENSCHEL MIXER to prepare a toner composition. The properties of the toner compositions are described in Table Five (5) parts of each of the thus prepared toner compositions were mixed with 95 parts of a silicone-coated copper-zinc ferrite carrier to prepare two component developers. Each of the developers was set in an image forming apparatus, IMAGIO NEO 450 from Ricoh Co., Ltd., which can produce images having A4 size at a speed of 45 sheets/min, to perform a running test. The results are shown in Table 4.

Evaluation Item and Evaluation Method (a) Particle Diameter

The particle diameter (i.e., weight average particle diameter and number average particle diameter) of a toner was measured with a particle diameter measuring instrument, COULTER COUNTER TAII, manufactured by Coulter Electronics, Inc., which was equipped with an aperture having a diameter of 100 μm.

(b) Charge Quantity (Q/M)

Six (6) grams of a developer were contained in a closed metal cylinder and subjected to a blow-off treatment to determine the charge quantity of the toner. In this case, the toner concentration of the developer was adjusted so as to range from 4.5 to 5.5% by weight.

(c) Fixability

Each developer was set in a copier, IMAGIO NEO 450, which can produce 45 copies of A4 size per minute, and black solid images were continuously produced on a plain paper (TYPE 6200 paper from Ricoh Co., Ltd.) and a thick paper (COPY/PRINT PAPER 135 from NBS Ricoh) while the developing conditions were controlled such that the weight of the solid toner image is 1.0±0.1 mg/cm$^2$.

In addition, the temperature of the fixing roller was changed to determine the offset temperature (when the plain paper was used) and the minimum fixable temperature (when the thick paper was used). The minimum fixable temperature was defined as the lowest fixing temperature of the heat roller in a fixing temperature range in which when a fixed image was rubbed with a pad, the image has an image density not lower than 70% of the original image density.

(d) Circularity

The method for determining the circularity of a toner is as follows.

(1) 0.1 g to 0.5 g of a sample to be measured was mixed with 100 to 150 ml of water from which solid impurities had been removed and which includes 0.1 ml to 0.5 ml of a dispersant (i.e., a surfactant) such as an alkylbenzene sulfonic acid salt;

(2) the mixture was dispersed using an ultrasonic dispersing machine for about 1 to 3 minutes to prepare a suspension including particles of 3,000 to 10,000 per 1 micro-liter of the suspension; and (3) the average spherical degree of the sample in the suspension was determined by the measuring instrument mentioned above.

(e) Content of Particulate Resin in Toner

The quantity of styrene monomer which was a heat decomposition product of the particulate styrene-acrylic resin in the toner was determined by a pyrolytic gas chromatograph mass spectrometer (QR-5000 manufactured by Shimadzu Corp.) and a Curie point pyrolyzer (JHP-35 manufactured by Japan_Analytical Industry Co., Ltd.) which serves as a heater.

A working curve was previously prepared by measuring the quantity of styrene when toner samples in which the styrene-acrylic resin is mixed with a toner in an amount of 0.01%, 0.10%, 1.00%, 3.00% or 10.0% by weight were decomposed upon application of heat.

The conditions of the instruments are as follows:

Decomposing temperature: 590° C. (12 seconds)

Column: DB-1 (Length of 30 m, inside diameter of 0.25 mm and film of 0.25μ)

Temperature of column: 40° C. (retained for 2 minutes) to 300° C.

Temperature rising speed: 10° C./min

Temperature of vaporizing chamber: 300° C.

(f) Glass Transition Temperature (Tg)

The measuring method is mentioned above.

(g) Image Qualities

Each of the toners was set in the copier IMAGIO NEO 450 and 50,000 images were continuously produced using an original image having an image area proportion of 5%. The images were evaluated with respect to the following items.

1) Image Density

The image density of a solid image was measured with a densitometer X-Rite from X-Rite Co.

2) Background Fouling

When a white image was developed, the copier was suddenly turned off. The toner particles, which were present on the photoreceptor after a developing operation, were transferred to an adhesive tape. The optical densities of a blank adhesive tape and the adhesive tape on which the toner particles were adhered were measured with a spectro-densitometer 938 from X-Rite Co., to determine the difference in density therebetween.

(i) Cleanability

The toner particles which remained on the photoreceptor even after a cleaning operation were transferred using an adhesive tape, SCOTCH TAPE from Sumitomo 3M Ltd. The tape was set on a white paper to determine the difference in density between a blank adhesive tape and the adhesive tape with toner particles. The density was measured by a reflection densitometer RD514 manufactured by Macbeth Co. Cleanability is graded as follows.

○: difference in density is not greater than 0.01 (good)

X: difference in density is greater than 0.01 (bad)

(j) Filming Resistance

After the 50,000-sheet running test, the developing roller and the photoreceptor were visually observed to determine whether a film of the toner is formed thereon. Filming resistance is graded as follows.

○: No film is formed thereon. (good)

Δ: A streak-like film is formed thereon.

X: A film is formed on the entire surface of the members. (bad)

TABLE 2

| | | Properties of particulate resin | | |
|---|---|---|---|---|
| | No. of fine particle dispersion | Tg (° C.) | Weight average molecular weight | Volume average particle diameter (nm) |
| Ex. 7 | (11) | 59 | 150,000 | 105 |
| Ex. 8 | (12) | 42 | 30,000 | 120 |
| Ex. 9 | (13) | 78 | 25,000 | 110 |
| Ex. 10 | (14) | 51 | 100,000 | 115 |
| Ex. 11 | (15) | 56 | 150,000 | 90 |
| Ex. 12 | (11) | 59 | 150,000 | 105 |
| Ex. 13 | (15) | 56 | 150,000 | 90 |
| Comp. Ex. 6 | — | — | — | — |
| Comp. Ex. 7 | — | — | — | — |
| Comp. Ex. 8 | (16) | 152 | 400,000 | 140 |
| Comp. Ex. 9 | (17) | 30 | 5,000 | 130 |
| Comp. Ex. 10 | (11) | 59 | 150,000 | 105 |
| Comp. Ex. 11 | (11) | 59 | 150,000 | 105 |

TABLE 3

| | | Toner properties | | | | | | |
|---|---|---|---|---|---|---|---|---|
| | Toner No. | D4 (μm) | Dn (μm) | D4/Dn | Circularity | Content of resin* | $T_L$*2 (° C.) | $T_{OFF}$*3 (° C.) |
| Ex. 7 | (11) | 5.99 | 5.70 | 1.05 | 0.953 | 2.2 | 145 | 240 |
| Ex. 8 | (12) | 6.13 | 5.62 | 1.09 | 0.965 | 1.5 | 130 | 240 |
| Ex. 9 | (13) | 5.82 | 5.29 | 1.10 | 0.961 | 0.8 | 160 | 240 |
| Ex. 10 | (14) | 5.09 | 4.24 | 1.20 | 0.927 | 4.6 | 150 | 240 |
| Ex. 11 | (15) | 6.33 | 5.65 | 1.12 | 0.917 | 3.1 | 135 | 240 |
| Ex. 12 | (16) | 6.17 | 5.61 | 1.10 | 0.929 | 2.6 | 150 | 240 |
| Ex. 13 | (17) | 4.72 | 4.03 | 1.17 | 0.951 | 3.1 | 125 | 240 |
| Comp. Ex. 6 | (18) | 6.79 | 5.52 | 1.23 | 0.981 | — | 190 | 240 |
| Comp. Ex. 7 | (19) | 6.61 | 5.55 | 1.19 | 0.938 | — | 175 | 240 |
| Comp. Ex. 8 | (20) | 5.64 | 4.90 | 1.15 | 0.947 | 3.1 | — | — |
| Comp. Ex. 9 | (21) | 5.17 | 4.27 | 1.21 | 0.951 | 2.7 | 120 | 240 |
| Comp. Ex. 10 | (22) | 8.31 | 2.91 | 2.86 | 0.969 | 0.3 | 135 | 240 |
| Comp. Ex. 11 | (23) | 6.08 | 5.81 | 1.05 | 0.959 | 6.3 | — | — |

Content of resin*: Content (% by weight) of particulate resin in the toner $T_{LOFF}$*2: Minimum fixable temperature $T_{OFF}$*3: Minimum hot offset temperature

TABLE 4

| | Toner | Charge quantity (−μC/g) | | | Image density | | |
|---|---|---|---|---|---|---|---|
| | No. | Start* | 10K*2 | End*3 | Start | 10K | End |
| Ex. 7 | (11) | 35.6 | 36.3 | 32.4 | 1.38 | 1.39 | 1.41 |
| Ex. 8 | (12) | 35.7 | 34.9 | 33.6 | 1.39 | 1.37 | 1.41 |
| Ex. 9 | (13) | 29.5 | 30.9 | 27.8 | 1.44 | 1.43 | 1.39 |
| Ex. 10 | (14) | 30.4 | 30.2 | 28.8 | 1.45 | 1.44 | 1.40 |
| Ex. 11 | (15) | 32.5 | 31.2 | 30.5 | 1.43 | 1.44 | 1.41 |
| Ex. 12 | (16) | 33.4 | 32.4 | 30.6 | 1.42 | 1.43 | 1.40 |
| Ex. 13 | (17) | 29.5 | 30.1 | 27.4 | 1.43 | 1.39 | 1.38 |
| Comp. Ex. 6 | (18) | 29.9 | — | — | 1.29 | — | — |
| Comp. Ex. 7 | (19) | 32.4 | 18.9 | — | 1.40 | 1.45 | — |
| Comp. Ex. 8 | (20) | 31.5 | — | — | — | — | — |
| Comp. Ex. 9 | (21) | 34.3 | — | — | 1.21 | — | — |
| Comp. Ex. 10 | (22) | 30.4 | — | — | 1.35 | — | — |
| Comp. Ex. 11 | (23) | — | — | — | — | — | — |

| | Background fouling | | | Cleanability | | | Filming | Overall |
|---|---|---|---|---|---|---|---|---|
| | Start | 10K | End | Start | 10K | End | End | Evaluation |
| Ex. 7 | 0.01 | 0.00 | 0.01 | ○ | ○ | ○ | ○ | ○ |
| Ex. 8 | 0.00 | 0.00 | 0.01 | ○ | ○ | ○ | ○ | ○ |
| Ex. 9 | 0.01 | 0.01 | 0.02 | ○ | ○ | ○ | ○ | ○ |
| Ex. 10 | 0.01 | 0.01 | 0.01 | ○ | ○ | ○ | ○ | ○ |
| Ex. 11 | 0.00 | 0.01 | 0.00 | ○ | ○ | ○ | ○ | ○ |
| Ex. 12 | 0.00 | 0.00 | 0.00 | ○ | ○ | ○ | ○ | ○ |
| Ex. 13 | 0.01 | 0.00 | 0.02 | ○ | ○ | ○ | ○ | ○ |
| Comp. Ex. 6 | 0.03 | — | — | X | — | — | — | X |
| Comp. Ex. 7 | 0.02 | 0.43 | — | ○ | ○ | — | — | X |
| Comp. Ex. 8 | — | — | — | ○ | — | — | — | X |
| Comp. Ex. 9 | 0.01 | — | — | ○ | — | — | — | X |
| Comp. Ex. 10 | 0.03 | — | — | ○ | — | — | ○ | X |
| Comp. Ex. 11 | — | — | — | — | — | — | — | X |

Start*: At the start of the running test.
10K*2: After 10,000 images are produced.
End*2: After 100,000 images are produced.

Manufacturing Example 35

Synthesis of Particulate Resin Emulsion

The following components were contained in a reaction container having a stirrer and a thermometer and agitated for 15 minutes by a stirrer at a speed of 400 rpm to prepare a white emulsion.

| | |
|---|---|
| Water | 683 |
| Sodium salt of sulfate of ethylene oxide adduct of methacrylic acid (ELEMINOL RS-30, manufactured by Sanyo Chemical Industries Ltd.) | 11 |
| Styrene | 138 |
| Methacrylic acid | 138 |
| Ammonium persulfate | 1 |

The emulsion was heated to 75° C. to perform a reaction for 5 hours.

Further, 30 parts of a 1% aqueous solution of ammonium persulfate were added thereto and the mixture was aged at 75° C. for 5 hours to prepare an aqueous dispersion of a vinyl resin (styrene-methacrylic acid-butyl acrylate-sodium salt of sulfate of ethylene oxide adduct of methacrylic acid copolymer) The volume average particle diameter of the thus prepared fine particle dispersion (21) was 140 nm when measured with a particle diameter measuring instrument LA-920. A part of the fine particle dispersion (21) was dried to isolate the resin component. The glass transition temperature (Tg) of the resin component was 152° C.

Manufacturing Example 36

Preparation of Aqueous Phase

The following components were mixed while agitated to prepare a milky liquid.

| | |
|---|---|
| Deionized water | 990 |
| Fine particle dispersion (21) | 83 |
| Aqueous solution of sodium salt of dodecyl diphenyl ether disulfonic acid (ELEMINOL MON-7, manufactured by Sanyo Chemical Industries Ltd., solid content of 48.5%) | 37 |
| Ethyl acetate | 90 |

Thus, an aqueous phase liquid (21) was prepared.

Manufacturing Example 37

Synthesis of Second Binder Resin

The following components were contained in a reaction container having a condenser, a stirrer and a nitrogen introducing tube and reacted for 8 hours at 230° C. under a normal pressure.

| | |
|---|---|
| Adduct of 2 mole of ethylene oxide with bisphenol A | 229 |
| Adduct of 3 mole of propylene oxide with bisphenol A | 529 |
| Terephthalic acid | 208 |
| Adipic acid | 46 |
| Dibutyl tin oxide | 2 |

Then the reaction was further continued for 5 hours under a reduced pressure of from 10 to 15 mmHg. Further, 44 parts of trimellitic anhydride were added thereto to perform a reaction for 2 hours at 180° C. under a normal pressure. Thus, a second binder resin (21) was prepared. The second binder resin (21) has a number average molecular weight of 2500, a weight average molecular weight of 6700, a Tg of 43° C., and an acid value of 25 mgKOH/g.

Manufacturing Example 38

Synthesis of Intermediate Polyester for Prepolymer Having Isocyanate Group

The following components were contained in a reaction container having a condenser, a stirrer and a nitrogen introducing tube and reacted for 8 hours at 230° C. under a normal pressure.

| | |
|---|---|
| Adduct of 2 mole of ethylene oxide with bisphenol A | 682 |
| Adduct of 2 mole of propylene oxide with bisphenol A | 81 |
| Terephthalic acid | 283 |
| Trimellitic anhydride | 22 |
| Dibutyl tin oxide | 2 |

Then the reaction was further continued for 5 hours under a reduced pressure of from 10 to 15 mmHg. Thus, an intermediate polyester (21) was prepared. The intermediate polyester (21) has a number average molecular weight of 2100, a weight average molecular weight of 9500, a Tg of 55° C., an acid value of 0.5 mgKOH/g and a hydroxyl value of 51 mgKOH/g.

Then the following components were contained in a reaction container having a condenser, a stirrer and a nitrogen introducing tube and reacted for 5 hours at 100° C. to prepare a prepolymer (21).

| | |
|---|---|
| The intermediate polyester (21) | 410 |
| Isophorone diisocyanate | 89 |
| Ethyl acetate | 500 |

The prepolymer (21) included free isocyanate in an amount of 1.56% by weight. The solid content of the prepolymer (21) was 50% by weight when measured by heating the prepolymer at 130° C. for 30 minutes.

Manufacturing Example 39

Preparation of Ketimine Compound

In a reaction container having a stirrer and a thermometer, 170 parts of isophorone diamine and 75 parts of methyl ethyl ketone were contained and reacted for 5 hours at 50° C. to prepare a ketimine compound (21). The ketimine compound (21) had an amine value of 418 mgKOH/g.

Manufacturing Example 40

Preparation of Master Batch

The following components were mixed with a HENSCHEL MIXER manufactured by Mitsui Mining Co., Ltd.

| | |
|---|---|
| Water | 1200 |
| Carbon black | 800 |
| Polyester resin | 800 |

The mixture was kneaded for 30 minutes at 150° C. by a two-roll mill and crushed by a pulverizer after cooling to prepare a master batch (21).

Manufacturing Example 41

Preparation of Master Batch

The following components were mixed with a HENSCHEL MIXER manufactured by Mitsui Mining Co., Ltd.

| | |
|---|---|
| Water | 1200 |
| C.I. Pigment Yellow 180 | 800 |
| Polyester resin | 800 |

The mixture was kneaded for 30 minutes at 150° C. by a two-roll mill and crushed by a pulverizer after cooling to prepare a master batch (22).

Manufacturing Example 42

Preparation of Master Batch

The following components were mixed with a HENSCHEL MIXER manufactured by Mitsui Mining Co., Ltd.

| | |
|---|---|
| Water | 1200 |
| Cu-phthalocyanine 15:3 | 800 |
| Polyester resin | 800 |

The mixture was kneaded for 30 minutes at 150° C. by a two-roll mill and crushed by a pulverizer after cooling to prepare a master batch (23).

Manufacturing Example 43

Preparation of Master Batch

The following components were mixed with a HENSCHEL MIXER manufactured by Mitsui Mining Co., Ltd.

| | |
|---|---|
| Water | 1200 |
| C.I. Pigment Red 122 | 800 |
| Polyester resin | 800 |

The mixture was kneaded for 30 minutes at 150° C. by a two-roll mill and crushed by a pulverizer after cooling to prepare a master batch (24).

Manufacturing Example 44

Preparation of Oil Phase Liquid

The following components were contained in a reaction container having a stirrer and a thermometer.

| | |
|---|---|
| Synthesized ester wax | 100 |
| Charge controlling agent (salicylic metal complex E-84, manufactured by Orient Chemical Industries Ltd.) | 20 |
| Ethyl acetate | 880 |

The mixture was heated to 80° C. while agitated. After the mixture was agitated at 80° C. for 5 hours, the mixture was cooled to 30° C. in an hour.

Next, 400 parts of the master batch (21) and 600 parts of ethyl acetate were added thereto and the mixture was mixed for 1 hour to prepare a material solution (21).

The material solution (21) of 600 parts was transferred to a container and was subjected to a dispersion treatment using a bead mill (ULTRA VISCO MILL, manufactured by Aimex Co., Ltd.) under the following condition.

Liquid feeding speed: 1 kg/hour

Disc rotating speed: 6 m/second

Beads: zirconia beads having a size of 0.5 mm were contained in the mill in an amount of 80% by volume based on the volume of the vessel Number of times of dispersion: 3 to 12 times (i.e., 3-12 passes)

Next, 2024 parts of a 65% ethyl acetate solution of the second binder resin (21) were added thereto and the mixture was passed once through the bead mill under the above-mentioned conditions to prepare a pigment/wax dispersion (21). The solid content of the pigment/wax dispersion (21) was 49% when measured by heating the dispersion at 130° C. for 30 minutes.

Manufacturing Example 45

Preparation of Oil Phase Liquid

The procedure for preparation of the pigment/wax dispersion (21) was repeated except that the master batch (21) was replaced with the master batch (22) to prepare a pigment/wax dispersion (22). The solid content of the pigment/wax dispersion (22) was 50%.

Manufacturing Example 46

Preparation of Oil Phase Liquid

The procedure for preparation of the pigment/wax dispersion (21) was repeated except that the master batch (21) was replaced with the master batch (23) to prepare a pigment/wax dispersion (23). The solid content of the pigment/wax dispersion (23) was 49%.

Manufacturing Example 47

Preparation of Oil Phase Liquid

The procedure for preparation of the pigment/wax dispersion (21) was repeated except that the master batch (21) was replaced with the master batch (24) to prepare a pigment/wax dispersion (24). The solid content of the pigment/wax dispersion (24) was 50%.

Example 14

Preparation of Toner

The following components were contained in a container.

| | |
|---|---|
| Pigment/wax dispersion (21) | 806 |
| Prepolymer (21) | 505 |
| Ketimine compound (21) | 10.7 |

The components were mixed by a TK HOMOMIXER (manufactured by Tokushu Kika Kogyo Co., Ltd.) at a speed of 5,000 rpm for 1 minute.

Then 1,960 parts of the aqueous phase (21) were added thereto to be mixed by the TK. HOMOMIXER at a speed of 13,000 rpm for 20 minutes to prepare an emulsion slurry (21).

The emulsion slurry (21) was contained in a container having a stirrer and a thermometer to be subjected to a solvent removing treatment at 30° C. for 8 hours, followed by aging at 50° C. for 8 hours to prepare a dispersion slurry (21).

The dispersion slurry (21) of 100 parts was filtered under a reduced pressure. Then the following operations were performed to prepare a filter cake (21).

(1) 100 parts of ion-exchanged water were added to the cake obtained by filtering the dispersion slurry (21) and the mixture was mixed for 10 minutes by a TK HOMOMIXER at a speed of 12,000 rpm, followed by filtering to prepare a filtered cake (a3).

(2) 100 parts of a 10% aqueous solution of sodium hydroxide were added to the filtered cake (a3) and the mixture was mixed for 30 minutes by the TK HOMOMIXER at a speed of 12,000 rpm while applying ultrasonic vibration, followed by filtering under a reduced pressure to prepare a filtered cake (b3).

(3) 100 parts of a 10% aqueous solution of hydrochloric acid were added to the filter cake (b3) and the mixture was mixed for 10 minutes by the TK HOMOMIXER at a speed of 12,000 rpm, followed by filtering to prepare a filtered cake (c3).

(4) 300 parts of ion-exchanged water were added to the filtered cake (c3) and the mixture was mixed for 10 minutes by the TK HOMOMIXER at a speed of 12,000 rpm, followed by filtering. This operation was performed twice to prepare the filtered cake (21).

The filter cake (21) was dried by an air dryer at 45° C. for 48 hours, followed by sifting with a screen having 75 μm openings to prepare a toner (31) (i.e., toner particles).

Example 15

Preparation of Toner

The procedure for preparation of the toner (31) was repeated except that the pigment/wax dispersion (21) was replaced with the pigment/wax dispersion (22) to prepare a toner (32).

Example 16

Preparation of Toner

The procedure for preparation of the toner (31) was repeated except that the pigment/wax dispersion (21) was replaced with the pigment/wax dispersion (23) to prepare a toner (33).

Example 17

Preparation of Toner

The procedure for preparation of the toner (31) was repeated except that the pigment/wax dispersion (21) was replaced with the pigment/wax dispersion (24) to prepare a toner (34).

Manufacturing Example 48

Preparation of Oil Phase Liquid

The material solution (21) of 600 parts was contained in a container and was subjected to a dispersion treatment using a bead mill (ULTRA VISCO MILL, manufactured by Aimex Co., Ltd.) under the following condition.

Liquid feeding speed: 1 kg/hour

Disc rotating speed: 6 m/second

Beads: zirconia beads having a size of 0.5 mm were contained in the mill in an amount of 80% by volume based on the volume of the vessel Number of times of dispersion: 3 to 12 times (i.e., 3-12 passes)

Next, 588 parts of a 65% ethyl acetate solution of the second binder resin (21) were added thereto and the mixture was passed once through the bead mill under the above-mentioned conditions to prepare a pigment/wax dispersion (25). The solid content of the pigment/wax dispersion (25) was 50% when measured by heating the dispersion at 130° C. for 30 minutes.

Manufacturing Example 49

Preparation of Oil Phase Liquid

The procedure for preparation of the pigment/wax dispersion (25) was repeated except that the master batch (21) in the material solution (21) was replaced with the master batch (22) to prepare a pigment/wax dispersion (26). The solid content of the pigment/wax dispersion (26) was 50%.

Manufacturing Example 50

Preparation of Oil Phase Liquid

The procedure for preparation of the pigment/wax dispersion (25) was repeated except that the master batch (21) in the material solution (21) was replaced with the masterbatch (23) to prepare a pigment/wax dispersion (27). The solid content of the pigment/wax dispersion (27) was 50%.

Manufacturing Example 51

Preparation of Oil Phase Liquid

The procedure for preparation of the pigment/wax dispersion (25) was repeated except that the master batch (21) in the material solution (21) was replaced with the master batch (24) to prepare a pigment/wax dispersion (28). The solid content of the pigment/wax dispersion (28) was 50%.

Example 18

Preparation of Toner

Emulsification and Removal of Solvent

The following components were contained in a container.

| | |
|---|---|
| Pigment/wax dispersion (25) | 888 |
| Prepolymer (21) | 146 |
| Ketimine compound (21) | 6.2 |

The components were mixed by a TK HOMOMIXER (manufactured by Tokushu Kika Kogyo Co., Ltd.) at a speed of 5,000 rpm for 1 minute.

Then 1,960 parts of the aqueous phase liquid (21) were added thereto to be mixed by the TK HOMOMIXER at a speed of 13,000 rpm for 20 minutes to prepare an emulsion slurry (22).

The emulsion slurry (22) was contained in a container having a stirrer and a thermometer to be subjected to a solvent removing treatment at 30° C. for 8 hours, followed by aging at 50° C. for 8 hours to prepare a dispersion slurry (22).

Washing and Drying

The dispersion slurry (22) of 100 parts was filtered under a reduced pressure. Then the following operations were performed to prepare a filter cake (22).

(1) 100 parts of ion-exchanged water were added to the cake obtained by filtering the dispersion slurry (22) and the mixture was mixed for 10 minutes by a TK HOMOMIXER at a speed of 12,000 rpm, followed by filtering to prepare a filtered cake (a4).

(2) 100 parts of a 10% aqueous solution of sodium hydroxide were added to the filtered cake (a4) and the mixture was mixed for 30 minutes by the TK HOMOMIXER at a speed of 12,000 rpm while applying ultrasonic vibration, followed by filtering under a reduced pressure to prepare a filtered cake (b4).

(3) 100 parts of a 10% aqueous solution of hydrochloric acid were added to the filter cake (b4) and the mixture was mixed for 10 minutes by the TK HOMOMIXER at a speed of 12,000 rpm, followed by filtering to prepare a filtered cake (c4).

(4) 300 parts of ion-exchanged water were added to the filtered cake (c4) and the mixture was mixed for 10 minutes by the TK HOMOMIXER at a speed of 12,000 rpm, followed by filtering. This operation was performed twice to prepare the filtered cake (22).

The filtered cake (22) was dried by an air dryer at 45° C. for 48 hours, followed by sifting with a screen having 75 μm openings to prepare a toner (35) (i.e., toner particles).

Example 19

Preparation of Toner

The procedure for preparation of the toner (35) in Example 18 was repeated except that the pigment/wax dispersion (25) was replaced with the pigment/wax dispersion (26) to prepare a toner (36).

Example 20

Preparation of Toner

The procedure for preparation of the toner (35) in Example 18 was repeated except that the pigment/wax dispersion (25) was replaced with the pigment/wax dispersion (27) to prepare a toner (37).

Example 21

Preparation of Toner

The procedure for preparation of the toner (35) in Example 18 was repeated except that the pigment/wax dispersion (25) was replaced with the pigment/wax dispersion (28) to prepare a toner (38).

Manufacturing Example 52

Synthesis of Particulate Resin Emulsion

The procedure for preparation of the fine particle dispersion (21) in Manufacturing Example 35 was repeated except that 138 parts of styrene and 138 parts of methacrylic acid were replaced with 69 parts of styrene, 110 parts of methacrylic acid and 96 parts of butyl acrylate. Thus, a fine particle dispersion (22) was prepared. The volume average particle diameter of the fine particle dispersion (22) was 0.90 μm. A part of the fine particle dispersion (22) was dried to prepare a solid vinyl resin. The vinyl resin had a Tg of 60° C.

Manufacturing Example 53

Preparation of Aqueous Phase Liquid

The procedure for preparation of the aqueous phase liquid (21) in Manufacturing Example 36 was repeated except that the fine particle dispersion (21) was replaced with the fine particle dispersion (22) to prepare an aqueous phase liquid (22).

Example 22

Preparation of Toner

Emulsification and Removal of Solvent

The following components were contained in a container.

| | |
|---|---|
| Pigment/wax dispersion (25) | 888 |
| Prepolymer (21) | 146 |
| Ketimine compound (21) | 6.2 |

The components were mixed by a TK HOMOMIXER (manufactured by Tokushu Kika Kogyo Co., Ltd.) at a speed of 5,000 rpm for 1 minute.

Then 1,960 parts of the aqueous phase (22) were added thereto to be mixed by the TK HOMOMIXER at a speed of 13,000 rpm for 20 minutes to prepare an emulsion slurry (23).

The emulsion slurry (23) was contained in a container having a stirrer and a thermometer to be subjected to a solvent removing treatment at 30° C. for 8 hours, followed by aging at 50° C. for 8 hours to prepare a dispersion slurry (23).

Washing and Drying

The dispersion slurry (23) of 100 parts was filtered under a reduced pressure. Then the following operations were performed to prepare a filter cake (23).

(1) 100 parts of ion-exchanged water were added to the cake obtained by filtering the dispersion slurry (23) and the mixture was mixed for 10 minutes by a TK HOMOMIXER at a speed of 12,000 rpm, followed by filtering to prepare a filtered cake (a5).

(2) 100 parts of a 10% aqueous solution of sodium hydroxide were added to the filtered cake (a5) and the mixture was mixed for 30 minutes by the TK HOMOMIXER at a speed of 12,000 rpm while applying ultrasonic vibration, followed by filtering under a reduced pressure to prepare a filtered cake (b5).

(3) 100 parts of a 10% aqueous solution of hydrochloric acid were added to the filter cake (b5) and the mixture was mixed for 10 minutes by the TK HOMOMIXER at a speed of 12,000 rpm, followed by filtering to prepare a filtered cake (c5).

(4) 300 parts of ion-exchanged water were added to the filtered cake (c5) and the mixture was mixed for 10 minutes by the TK HOMOMIXER at a speed of 12,000 rpm, followed by filtering. This operation was performed twice to prepare the filtered cake (23).

The filter cake (23) was dried by an air dryer at 45° C. for 48 hours, followed by sifting with a screen having 75 μm openings to prepare a particulate toner (39) (i.e., toner particles).

Example 23

Preparation of Toner

The procedure for preparation of the toner (39) in Example 22 was repeated except that the pigment/wax dispersion (25) was replaced with the pigment/wax dispersion (26) to prepare a toner (40).

Example 24

Preparation of Toner

The procedure for preparation of the toner (39) in Example 22 was repeated except that the pigment/wax dispersion (25) was replaced with the pigment/wax dispersion (27) to prepare a toner (41).

Example 25

Preparation of Toner

The procedure for preparation of the toner (39) in Example 22 was repeated except that the pigment/wax dispersion (25) was replaced with the pigment/wax dispersion (28) to prepare a toner (42).

Manufacturing Example 54

Synthesis of Particulate Resin Emulsion

The procedure for preparation of the fine particle dispersion (21) in Manufacturing Example 35 was repeated except that 138 parts of styrene and 138 parts of methacrylic acid were replaced with 83 parts of styrene, 83 parts of methacrylic acid and 111 parts of butyl acrylate. Thus, a fine particle dispersion (23) was prepared. The volume average particle diameter of the fine particle dispersion (23) was 0.10 μm. A part of the fine particle dispersion (23) was dried to prepare a solid vinyl resin. The vinyl resin had a Tg of 60° C.

Manufacturing Example 55

Preparation of Aqueous Phase Liquid

The procedure for preparation of the aqueous phase liquid (21) in Manufacturing Example 36 was repeated except that the fine particle dispersion (21) was replaced with the fine particle dispersion (23) to prepare an aqueous phase liquid (23).

Example 26

Preparation of Toner

Emulsification and Removal of Solvent

The following components were contained in a container.

| | |
|---|---|
| Pigment/wax dispersion (25) | 888 |
| Prepolymer (21) | 146 |
| Ketimine compound (21) | 6.2 |

The components were mixed by a TK HOMOMIXER (manufactured by Tokushu Kika Kogyo Co., Ltd.) at a speed of 5,000 rpm for 1 minute.

Then 1,960 parts of the aqueous phase liquid (23) were added thereto to be mixed by the TK HOMOMIXER at a speed of 13,000 rpm for 20 minutes to prepare an emulsion slurry (24).

The emulsion slurry (24) was contained in a container having a stirrer and a thermometer to be subjected to a solvent removing treatment at 30° C. for 8 hours, followed by aging at 50° C. for 8 hours to prepare a dispersion slurry (24).

Washing and Drying

The dispersion slurry (24) of 100 parts was filtered under a reduced pressure. Then the following operations were performed to prepare a filter cake (24).

(1) 100 parts of ion-exchanged water were added to the cake obtained by filtering the dispersion slurry (24) and the mixture was mixed for 10 minutes by a TK HOMOMIXER at a sped of 12,000 rpm, followed by filtering to prepare a filtered cake (a6).

(2) 100 parts of a 10% aqueous solution of sodium hydroxide were added to the filtered cake (a6) and the mixture was mixed for 30 minutes by the TK HOMOMIXER at a speed of 12,000 rpm while applying ultrasonic vibration, followed by filtering under a reduced pressure to prepare a filtered cake (b6).

(3) 100 parts of a 10% aqueous solution of hydrochloric acid were added to the filter cake (b6) and the mixture was mixed for 10 minutes by the TK HOMOMIXER at a speed of 12,000 rpm, followed by filtering to prepare a filtered cake (c6).

(4) 300 parts of ion-exchanged water were added to the filtered cake (c6) and the mixture was mixed for 10 minutes by the TK HOMOMIXER at a speed of 12,000 rpm, followed by filtering. This operation was performed twice to prepare the filtered cake (24).

The filter cake (24) was dried by an air dryer at 45° C. for 48 hours, followed by sifting with a screen having 75 μm openings to prepare a toner (43) (i.e., toner particles).

Example 27

Preparation of Toner

The procedure for preparation of the toner (43) in Example 26 was repeated except that the pigment/wax dispersion (25) was replaced with the pigment/wax dispersion (26) to prepare a toner (44).

Example 28

Preparation of Toner

The procedure for preparation of the toner (43) in Example 26 was repeated except that the pigment/wax dispersion (25) was replaced with the pigment/wax dispersion (27) to prepare a toner (45).

Example 29

Preparation of Toner

The procedure for preparation of the toner (43) in Example 26 was repeated except that the pigment/wax dispersion (25) was replaced with the pigment/wax dispersion (28) to prepare a toner (46).

Manufacturing Example 56

Synthesis of Second Binder Resin

The following components were contained in a reaction container having a condenser, a stirrer and a nitrogen introducing tube and reacted for 8 hours at 230° C. under normal pressure.

| | |
|---|---|
| Adduct of 2 mole of ethylene oxide with bisphenol A | 562 |
| Adduct of 2 mole of propylene oxide with bisphenol A | 75 |
| Adduct of 3 mole of propylene oxide with bisphenol A | 87 |
| Terephthalic acid | 143 |
| Adipic acid | 126 |
| Dibutyl tin oxide | 2 |

Then the reaction was further continued for 5 hours under a reduced pressure of from 10 to 15 mmHg. Further, 69 parts of trimellitic anhydride were added thereto to perform a reaction for 2 hours at 180° C. under a normal pressure. Thus, a second binder resin (22) (i.e., a low molecular weight polyester resin) was prepared. The second binder resin (22) has a number average molecular weight of 3700, a weight average molecular weight of 7200, a Tg of 43° C., and an acid value of 40 mgKOH/g.

Manufacturing Example 57

Preparation of Oil Phase Liquid

The material solution (21) of 600 parts was contained in a container and was subjected to a dispersion treatment using a bead mill (ULTRA VISCO MILL, manufactured by Aimex Co., Ltd.) under the following condition.

Liquid feeding speed: 1 kg/hour

Disc rotating speed: 6 m/second

Beads: zirconia beads having a size of 0.5 mm were contained in the mill in an amount of 80% by volume based on the volume of the vessel Number of times of dispersion: 3 to 12 times (i.e., 3-12 passes)

Next, 588 parts of a 65% ethyl acetate solution of the second binder resin (22) were added thereto and the mixture was passed once through the bead mill under the above-mentioned conditions to prepare a pigment/wax dispersion (29). The solid content of the pigment/wax dispersion (29) was 50% when measured by heating the dispersion at 130° C. for 30 minutes.

Manufacturing Example 58

Preparation of Oil Phase Liquid

The procedure for preparation of the pigment/wax dispersion (29) in Manufacturing Example 57 was repeated except that the master batch (21) in the material solution (21) was replaced with the master batch (22) to prepare a pigment/wax dispersion (30). The solid content of the pigment/wax dispersion (30) was 51%.

Manufacturing Example 59

Preparation of Oil Phase Liquid

The procedure for preparation of the pigment/wax dispersion (29) in Manufacturing Example 57 was repeated except that the master batch (21) in the material solution (21) was replaced with the master batch (23) to prepare a pigment/wax dispersion (31). The solid content of the pigment/wax dispersion (31) was 50%.

Manufacturing Example 60

Preparation of Oil Phase Liquid

The procedure for preparation of the pigment/wax dispersion (29) in Manufacturing Example 57 was repeated except that the master batch (21) in the material solution (21) was replaced with the master batch (24) to prepare a pigment/wax dispersion (32). The solid content of the pigment/wax dispersion (32) was 50%.

Example 30

Preparation of Toner

Emulsification and Removal of Solvent

The following components were contained in a container.

| | |
|---|---|
| Pigment/wax dispersion (29) | 888 |
| Prepolymer (21) | 146 |
| Ketimine compound (21) | 6.2 |

The components were mixed by a TK HOMOMIXER (manufactured by Tokushu Kika Kogyo Co., Ltd.) at a speed of 5,000 rpm for 1 minute.

Then 1,960 parts of the aqueous phase (23) were added thereto to be mixed by the TK HOMOMIXER at a speed of 13,000 rpm for 20 minutes to prepare an emulsion slurry (25).

The emulsion slurry (25) was contained in a container having a stirrer and a thermometer to be subjected to a solvent removing treatment at 30° C. for 8 hours, followed by aging at 50° C. for 8 hours to prepare a dispersion slurry (25).

Washing and Drying

The dispersion slurry (25) of 100 parts was filtered under a reduced pressure. Then the following operations were performed to prepare a filter cake (25).

(1) 100 parts of ion-exchanged water were added to the cake obtained by filtering the dispersion slurry (25) and the mixture was mixed for 10 minutes by a TK HOMOMIXER at a speed of 12,000 rpm, followed by filtering to prepare a filtered cake (a7).

(2) 100 parts of a 10% aqueous solution of sodium hydroxide were added to the filtered cake (a7) and the mixture was mixed for 30 minutes by the TK HOMOMIXER at a speed of 12,000 rpm while applying ultrasonic vibration, followed by filtering under a reduced pressure to prepare a filtered cake (b7).

(3) 100 parts of a 10% aqueous solution of hydrochloric acid were added to the filter cake (b7) and the mixture was mixed for 10 minutes by the TK HOMOMIXER at a speed of 12,000 rpm, followed by filtering to prepare a filtered cake (c7).

(4) 300 parts of ion-exchanged water were added to the filtered cake (c7) and the mixture was mixed for 10 minutes by the TK HOMOMIXER at a speed of 12,000 rpm, followed by filtering. This operation was performed twice to prepare the filtered cake (25).

The filtered cake (25) was dried by an air dryer at 45° C. for 48 hours, followed by sifting with a screen having 75 μm openings to prepare a particulate toner (47) (i.e., toner particles).

Example 31

Preparation of Toner

The procedure for preparation of the toner (47) in Example 30 was repeated except that the pigment/wax dispersion (29) was replaced with the pigment/wax dispersion (30) to prepare a toner (48).

Example 32

Preparation of Toner

The procedure for preparation of the toner (47) in Example 30 was repeated except that the pigment/wax dispersion (29) was replaced with the pigment/wax dispersion (31) to prepare a toner (49).

Example 33

Preparation of Toner

The procedure for preparation of the toner (47) in Example 30 was repeated except that the pigment/wax dispersion (29) was replaced with the pigment/wax dispersion (32) to prepare a toner (50).

Manufacturing Example 61

Synthesis of Second Binder Resin

The following components were contained in a reaction container having a condenser, a stirrer and a nitrogen introducing tube and reacted for 8 hours at 230° C. under a normal pressure.

| | |
|---|---|
| Adduct of 2 mole of ethylene oxide with bisphenol A | 319 |
| Adduct of 2 mole of propylene oxide with bisphenol A | 449 |
| Terephthalic acid | 243 |
| Adipic acid | 53 |
| Dibutyl tin oxide | 2 |

Then the reaction was further continued for 5 hours under a reduced pressure of from 10 to 15 mmHg. Further, 7 parts of trimellitic anhydride were added thereto to perform a reaction for 2 hours at 180° C. under a normal pressure. Thus, a second binder resin (23) (i.e., a low molecular weight polyester resin) was prepared. The second binder resin (23) has a number average molecular weight of 1900, a weight average molecular weight of 6100, a Tg of 43° C., and an acid value of 1.1 mgKOH/g.

Manufacturing Example 62

Preparation of Oil Phase Liquid

The material solution (21) of 600 parts was contained in a container and was subjected to a dispersion treatment using a bead mill (ULTRA VISCO MILL, manufactured by Aimex Co., Ltd.) under the following condition.

Liquid feeding speed: 1 kg/hour

Disc rotating speed: 6 m/second

Beads: zirconia beads having a size of 0.5 mm were contained in the mill in an amount of 80% by volume based on the volume of the vessel.

Number of times of dispersion: 3 to 12 times (i.e., 3-12 passes)

Next, 588 parts of a 65% ethyl acetate solution of the second binder resin (23) were added thereto and the mixture was passed once through the bead mill under the above-mentioned conditions to prepare a pigment/wax dispersion (33). The solid content of the pigment/wax dispersion (33) was 50% when measured by heating the dispersion at 130° C. for 30 minutes.

Manufacturing Example 63

Preparation of Oil Phase Liquid

The procedure for preparation of the pigment/wax dispersion (33) in Manufacturing Example 62 was repeated except that the master batch (21) in the material solution (21) was replaced with the master batch (22) to prepare a pigment/wax dispersion (34). The solid content of the pigment/wax dispersion (34) was 50%.

Manufacturing Example 64

Preparation of Oil Phase Liquid

The procedure for preparation of the pigment/wax dispersion (33) in Manufacturing Example 62 was repeated except that the master batch (21) in the material solution (21) was replaced with the master batch (23) to prepare a pigment/wax dispersion (35). The solid content of the pigment/wax dispersion (35) was 50%.

Manufacturing Example 65

Preparation of Oil Phase Liquid

The procedure for preparation of the pigment/wax dispersion (33) in Manufacturing Example 62 was repeated except that the master batch (21) in the material solution (21) was replaced with the master batch (24) to prepare a pigment/wax dispersion (36). The solid content of the pigment/wax dispersion (36) was 50%.

Example 34

Preparation of Toner

Emulsification and Removal of Solvent

The following components were contained in a container.

| | |
|---|---|
| Pigment/wax dispersion (33) | 888 |
| Prepolymer (21) | 146 |
| Ketimine compound (21) | 6.2 |

The components were mixed by a TK HOMOMIXER (manufactured by Tokushu Kika Kogyo Co., Ltd.) at a speed of 5,000 rpm for 1 minute.

Then 1,960 parts of the aqueous phase (23) were added thereto to be mixed by the TK HOMOMIXER at a speed of 13,000 rpm for 20 minutes to prepare an emulsion slurry (26).

The emulsion slurry (26) was contained in a container having a stirrer and a thermometer to be subjected to a solvent removing treatment at 30° C. for 8 hours, followed by aging at 50° C. for 8 hours to prepare a dispersion slurry (26).

Washing and Drying

The dispersion slurry (26) of 100 parts was filtered under a reduced pressure. Then the following operations were performed to prepare a filter cake (26).

(1) 100 parts of ion-exchanged water were added to the cake obtained by filtering the dispersion slurry (26) and the mixture was mixed for 10 minutes by a TK HOMOMIXER at a speed of 12,000 rpm, followed by filtering to prepare a filtered cake (a8).

(2) 100 parts of a 10% aqueous solution of sodium hydroxide were added to the filtered cake (a8) and the mixture was mixed for 30 minutes by the TK HOMOMIXER at a speed of 12,000 rpm while applying ultrasonic vibration, followed by filtering under a reduced pressure to prepare a filtered cake (b8).

(3) 100 parts of a 10% aqueous solution of hydrochloric acid were added to the filter cake (b8) and the mixture was mixed for 10 minutes by the TK HOMOMIXER at a speed of 12,000 rpm, followed by filtering to prepare a filtered cake (c8).

(4) 300 parts of ion-exchanged water were added to the filtered cake (c8) and the mixture was mixed for 10 minutes by the TK HOMOMIXER at a speed of 12,000 rpm, followed by filtering. This operation was performed twice to prepare the filtered cake (26).

The filtered cake (26) was dried by an air dryer at 45° C. for 48 hours, followed by sifting with a screen having 75 μm openings to prepare a toner (51) (i.e., toner particles).

Example 35

Preparation of Toner

The procedure for preparation of the toner (51) in Example 34 was repeated except that the pigment/wax dispersion (33) was replaced with the pigment/wax dispersion (34) to prepare a toner (52).

Example 36

Preparation of Toner

The procedure for preparation of the toner (51) in Example 34 was repeated except that the pigment/wax dispersion (33) was replaced with the pigment/wax dispersion (35) to prepare a toner (53).

Example 37

Preparation of Toner

The procedure for preparation of the toner (51) in Example 34 was repeated except that the pigment/wax dispersion (33) was replaced with the pigment/wax dispersion (36) to prepare a toner (54).

Comparative Example 12

Preparation of Toner

The procedure for preparation of the toner (18) in Comparative Example 6 was repeated to prepare a toner (55) (i.e., a comparative toner).

Comparative Example 13

Preparation of Toner

The procedures for preparation of the toner (19) in Manufacturing Examples 29 to 31 and Comparative Example 7 were repeated to prepare a toner (56) (i.e., a comparative toner)

Manufacturing Example 66

Synthesis of Particulate Resin Emulsion

The procedure for preparation of the fine particle dispersion (21) in Manufacturing Example 35 was repeated except that 138 parts of styrene and 138 parts of methacrylic acid were replaced with 166 parts of styrene and 110 parts of methacrylic acid. Thus, a fine particle dispersion (24) was prepared. The volume average particle diameter of the fine particle dispersion (24) was 0.12 μm. A part of the fine particle dispersion (24) was dried to prepare a solid vinyl resin. The vinyl resin having a ratio St/MAA of 60/40 had a Tg of 158° C.

Manufacturing Example 67

Preparation of Aqueous Phase Liquid

The procedure for preparation of the aqueous phase liquid (21) in Manufacturing Example 36 was repeated except that the fine particle dispersion (21) was replaced with the fine particle dispersion (24) to prepare an aqueous phase liquid (24).

Comparative Example 14

Preparation of Toner

Emulsification and Removal of Solvent

The following components were contained in a container.

| | |
|---|---|
| Pigment/wax dispersion (21) | 806 |
| Prepolymer (21) | 505 |
| Ketimine compound (21) | 10.7 |

The components were mixed by a TK HOMOMIXER (manufactured by Tokushu Kika Kogyo Co., Ltd.) at a speed of 5,000 rpm for 1 minute.

Then 1,960 parts of the aqueous phase liquid (24) were added thereto to be mixed by the TK HOMOMIXER at a speed of 13,000 rpm for 20 minutes to prepare an emulsion slurry (27).

The emulsion slurry (27) was contained in a container having a stirrer and a thermometer to be subjected to a solvent removing treatment at 30° C. for 8 hours, followed by aging at 50° C. for 8 hours to prepare a dispersion slurry (27).

Washing and Drying

The dispersion slurry (27) of 100 parts was filtered under a reduced pressure. Then the following operations were performed to prepare a filter cake (27).

(1) 100 parts of ion-exchanged water were added to the cake obtained by filtering the dispersion slurry (27) and the mixture was mixed for 10 minutes by a TK HOMOMIXER at a speed of 12,000 rpm, followed by filtering to prepare a filtered cake (a9).

(2) 100 parts of a 10% aqueous solution of sodium hydroxide were added to the filtered cake (a9) and the mixture was mixed for 30 minutes by the TK HOMOMIXER at a speed of 12,000 rpm while applying ultrasonic vibration, followed by filtering under a reduced pressure to prepare a filtered cake (b9).

(3) 100 parts of a 10% aqueous solution of hydrochloric acid were added to the filter cake (b9) and the mixture was mixed for 10 minutes by the TK HOMOMIXER at a speed of 12,000 rpm, followed by filtering to prepare a filtered cake (c9).

(4) 300 parts of ion-exchanged water were added to the filtered cake (c9) and the mixture was mixed for 10 minutes by the TK HOMOMIXER at a speed of 12,000 rpm, followed by filtering. This operation was performed twice to prepare the filtered cake (27).

The filter cake (27) was dried by an air dryer at 45° C. for 48 hours, followed by sifting with a screen having 75 μm openings to prepare a particulate toner (57) (i.e., toner particles).

Manufacturing Example 68

Preparation of Particulate Resin Emulsion

The procedure for preparation of the fine particle dispersion (21) in Manufacturing Example 35 was repeated except that 138 parts of styrene and 138 parts of methacrylic acid were replaced with 110 parts of styrene and 166 parts of methacrylic acid. Thus, a fine particle dispersion (25) was prepared. The volume average particle diameter of the fine particle dispersion (25) was 0.09 μm. A part of the fine particle dispersion (25) was dried to prepare a solid vinyl resin. The vinyl resin having a ratio St/MAA of 40/60 had a Tg of 153° C.

Manufacturing Example 69

Preparation of Aqueous Phase Liquid

The procedure for preparation of the aqueous phase liquid (21) in Manufacturing Example 36 was repeated except that the fine particle dispersion (21) was replaced with the fine particle dispersion (25) to prepare an aqueous phase liquid (25).

Comparative Example 15

Preparation of Toner

Emulsification and Removal of Solvent

The following components were contained in a container.

| | |
|---|---|
| Pigment/wax dispersion (21) | 806 |
| Prepolymer (21) | 505 |
| Ketimine compound (21) | 10.7 |

The components were mixed by a TK HOMOMIXER (manufactured by Tokushu Kika Kogyo Co., Ltd.) at a speed of 5,000 rpm for 1 minute.

Then 1,960 parts of the aqueous phase liquid (25) were added thereto to be mixed by the TK HOMOMIXER at a speed of 13,000 rpm for 20 minutes to prepare an emulsion slurry (28).

The emulsion slurry (28) was contained in a container having a stirrer and a thermometer to be subjected to a solvent removing treatment at 30° C. for 8 hours, followed by aging at 50° C. for 8 hours to prepare a dispersion slurry (28).

Washing and Drying

The dispersion slurry (28) of 100 parts was filtered under a reduced pressure. Then the following operations were performed to prepare a filter cake (28).

(1) 100 parts of ion-exchanged water were added to the filtered dispersion slurry and the mixture was mixed for 10 minutes by a TK HOMOMIXER at a speed of 12,000 rpm, followed by filtering to prepare a filtered cake (a10).

(2) 100 parts of a 10% aqueous solution of sodium hydroxide were added to the filtered cake (a10) and the mixture was mixed for 30 minutes by the TK HOMOMIXER at a speed of 12,000 rpm while applying ultrasonic vibration, followed by filtering under a reduced pressure to prepare a filtered cake (b10).

(3) 100 parts of a 10% aqueous solution of hydrochloric acid were added to the filter cake (b10) and the mixture was mixed for 10 minutes by the TK HOMOMIXER at a speed of 12,000 rpm, followed by filtering to prepare a filtered cake (c10).

(4) 300 parts of ion-exchanged water were added to the filtered cake (c10) and the mixture was mixed for 10 minutes by the TK HOMOMIXER at a speed of 12,000 rpm, followed by filtering. This operation was performed twice to prepare the filtered cake (28).

The filter cake (28) was dried by an air dryer at 45° C. for 48 hours, followed by sifting with a screen having 75 μm openings to prepare a particulate toner (58) (i.e., toner particles).

Manufacturing Example 70

Preparation of Particulate Resin Emulsion

The procedure for preparation of the fine particle dispersion (21) in Manufacturing Example 35 was repeated except that 138 parts of styrene and 138 parts of methacrylic acid were replaced with 28 parts of styrene, 138 parts of methacrylic acid and 110 parts of butyl acrylate. Thus, a fine particle dispersion (26) was prepared. The volume average particle diameter of the fine particle dispersion (26) was 0.10 μm. A part of the fine particle dispersion (26) was dried to prepare a solid vinyl resin. The vinyl resin having a ratio Sty/MAA/BA of Oct. 50, 1940 had a Tg of 65° C.

Manufacturing Example 71

Preparation of Aqueous Phase Liquid

The procedure for preparation of the aqueous phase liquid (21) in Manufacturing Example 36 was repeated except that the fine particle dispersion (21) was replaced with the fine particle dispersion (26) to prepare an aqueous phase liquid (26).

Comparative Example 16

Preparation of Toner

Emulsification and Removal of Solvent

The following components were contained in a container.

| | |
|---|---|
| Pigment/wax dispersion (21) | 806 |
| Prepolymer (21) | 505 |
| Ketimine compound (21) | 10.7 |

The components were mixed by a TK HOMOMIXER (manufactured by Tokushu Kika Kogyo Co., Ltd.) at a speed of 5,000 rpm for 1 minute.

Then 1,960 parts of the aqueous phase liquid (26) were added thereto to be mixed by the TK HOMOMIXER at a speed of 13,000 rpm for 20 minutes to prepare an emulsion slurry (29).

The emulsion slurry (29) was contained in a container having a stirrer and a thermometer to be subjected to a solvent removing treatment at 30° C. for 8 hours, followed by aging at 50° C. for 8 hours to prepare a dispersion slurry (29).

Washing and Drying

The dispersion slurry (29) of 100 parts was filtered under a reduced pressure. Then the following operations were performed to prepare a filter cake (29).

(1) 100 parts of ion-exchanged water were added to the cake obtained by filtering the dispersion slurry (29) and the mixture was mixed for 10 minutes by a TK HOMOMIXER at a speed of 12,000 rpm, followed by filtering to prepare a filtered cake (all).

(2) 100 parts of a 10% aqueous solution of sodium hydroxide were added to the filtered cake (all) and the mixture was mixed for 30 minutes by the TK HOMOMIXER at a speed of 12,000 rpm while applying ultrasonic vibration, followed by filtering under a reduced pressure to prepare a filtered cake (b11).

(3) 100 parts of a 10% aqueous solution of hydrochloric acid were added to the filter cake (b11) and the mixture was mixed for 10 minutes by the TK HOMOMIXER at a speed of 12,000 rpm, followed by filtering to prepare a filtered cake (c11).

(4) 300 parts of ion-exchanged water were added to the filtered cake (c11) and the mixture was mixed for 10 minutes by the TK HOMOMIXER at a speed of 12,000 rpm, followed by filtering. This operation was performed twice to prepare the filtered cake (29).

The filter cake (29) was dried by an air dryer at 45° C. for 48 hours, followed by sifting with a screen having 75 μm openings to prepare a particulate toner (59) (i.e., toner particles).

Preparation of Toner Composition and Developer

One hundred (100) parts of each of the thus prepared toners were mixed with 0.7 parts of a hydrophobic silica and 0.3 parts of a hydrophobic titanium oxide using a HENSCHEL MIXER to prepare toner compositions. The properties of the toner compositions are described in Table 5.

Five (5) parts of each of the thus prepared toner compositions were mixed with 95 parts of a silicone-coated copper-zinc ferrite carrier having an average particle diameter of 40 μm to prepare two component developers. Each of the developers was set in an image forming apparatus, IMAGIO NEO 450 from Ricoh Co., Ltd., which can produce images having A4 size at a speed of 45 sheets/min, to perform a running test. The results are shown in Tables 5 and 6. The evaluation items and methods are as follows.

Evaluation Item and Evaluation Method (a) Particle Diameter

The particle diameter (i.e., volume average particle diameter and number average particle diameter) of a toner was measured with a particle diameter measuring instrument, COULTER COUNTER TAII, manufactured by Coulter Electronics, Inc., which was equipped with an aperture having a diameter of 100 μm.

(b) Charge Quantity (Q/M)

The charge quantity was measured by the method mentioned above. The charge quantity was measured at the begging, a 10,000-image point (10K) and end of the 100,000-sheet (100K) running test.

(c) Fixability

Each developer was set in a copier, IMAGIO NEO 450, which can produce 45 copies of A4 size per minute, and black solid images were continuously produced on a plain paper (TYPE 6200 paper from Ricoh Co., Ltd.) and a thick paper (COPY/PRINT PAPER 135 from NBS Ricoh) while the developing conditions were controlled such that the weight of the solid toner image is 1.0±0.1 mg/cm$^2$.

In addition, the temperature of the fixing roller was changed to determine the offset temperature (when the plain paper was used) and the minimum fixable temperature (when the thick paper was used). The minimum fixable temperature was defined as the lowest fixing temperature of the heat roller in a fixing temperature range in which when a fixed image was rubbed with a pad, the image has an image density not lower than 70% of the original image density.

(d) Circularity

The circularity was measured by the method mentioned above.

(e) Image Qualities

1) Image Density

The image densities of five points of a solid image were measured with a densitometer X-Rite from X-Rite Co. to obtain an average image density. The average image density was measured with respect to four color toner images (i.e., black, yellow, cyan and magenta toner images). The image density was measured at the begging, a 10,000-image point (10K) and end of the 100,000-sheet (100K) running test.

2) Background Fouling

The background fouling was evaluated by the method mentioned above. The background fouling was evaluated with respect to the images produced at the begging, a 10,000-image point (10K) and end of the 100,000-sheet (100K) running test.

(i) Cleanability

The cleanability was evaluated by the method mentioned above. The cleanability was evaluated at the begging, a 10,000-image point (10K) and end of the 100,000-sheet (100K) running test. Cleanability is graded as follows.

○: difference in density is not greater than 0.01 (good)

X: difference in density is greater than 0.01 (bad)

(j) Filming Resistance

The filming resistance was evaluated by the method mentioned above. Filming was evaluated after the end of the 100,000-sheet (100K) running test. Filming resistance is graded as follows.

○: No film is formed. (good)

Δ: A streak-like film is formed.

X: A film is formed on the entire surface of the members. (bad)

TABLE 5

| | | Particle diameter distribution | | | | Fixability | |
|---|---|---|---|---|---|---|---|
| | Toner No. | Dv (μm) | Dn (μm) | Dv/Dn | Circularity | Min. fixable temp. (° C.) | Hot offset temp. (° C.) |
| Ex. 14 | (31) | 5.64 | 4.69 | 1.20 | 0.96 | 165 | 235 |
| Ex. 15 | (32) | 5.36 | 4.28 | 1.25 | 0.96 | 170 | 240 |
| Ex. 16 | (33) | 5.06 | 3.99 | 1.27 | 0.97 | 160 | 230 |
| Ex. 17 | (34) | 5.12 | 4.12 | 1.24 | 0.96 | 165 | 235 |
| Ex. 18 | (35) | 4.97 | 4.32 | 1.15 | 0.97 | 155 | 240 |
| Ex. 19 | (36) | 5.03 | 4.40 | 1.14 | 0.96 | 160 | 240 |
| Ex. 20 | (37) | 5.28 | 4.71 | 1.12 | 0.97 | 155 | 235 |
| Ex. 21 | (38) | 5.12 | 4.53 | 1.13 | 0.96 | 155 | 240 |
| Ex. 22 | (39) | 5.69 | 4.69 | 1.21 | 0.97 | 150 | 230 |
| Ex. 23 | (40) | 5.28 | 4.19 | 1.26 | 0.95 | 160 | 240 |
| Ex. 24 | (41) | 5.80 | 4.67 | 1.24 | 0.97 | 150 | 230 |
| Ex. 25 | (42) | 5.76 | 4.74 | 1.22 | 0.96 | 155 | 230 |
| Ex. 26 | (43) | 4.65 | 4.20 | 1.11 | 0.96 | 135 | 230 |
| Ex. 27 | (44) | 4.39 | 4.01 | 1.09 | 0.95 | 145 | 235 |
| Ex. 28 | (45) | 4.59 | 4.12 | 1.11 | 0.96 | 135 | 225 |
| Ex. 29 | (46) | 4.61 | 4.11 | 1.12 | 0.96 | 140 | 230 |
| Ex. 30 | (47) | 4.81 | 4.23 | 1.14 | 0.97 | 130 | 215 |
| Ex. 31 | (48) | 4.85 | 4.08 | 1.19 | 0.94 | 140 | 235 |
| Ex. 32 | (49) | 4.73 | 4.12 | 1.15 | 0.95 | 125 | 210 |
| Ex. 33 | (50) | 4.69 | 4.17 | 1.12 | 0.96 | 135 | 220 |
| Ex. 34 | (51) | 4.62 | 4.39 | 1.05 | 0.97 | 140 | 240 |
| Ex. 35 | (52) | 4.50 | 4.20 | 1.07 | 0.96 | 145 | 240 |
| Ex. 36 | (53) | 4.78 | 4.49 | 1.06 | 0.96 | 140 | 235 |
| Ex. 37 | (54) | 4.41 | 4.18 | 1.06 | 0.97 | 145 | 240 |

TABLE 5-continued

| | | Particle diameter distribution | | | | Fixability | |
|---|---|---|---|---|---|---|---|
| | Toner No. | Dv (μm) | Dn (μm) | Dv/Dn | Circularity | Min. fixable temp. (° C.) | Hot offset temp. (° C.) |
| Comp. Ex. 12 | (55) | 6.28 | 5.60 | 1.12 | 0.98 | 190 | 230 |
| Comp. Ex. 13 | (56) | 6.73 | 5.28 | 1.27 | 0.96 | 175 | 220 |
| Comp. Ex. 14 | (57) | 5.70 | 5.43 | 1.05 | 0.98 | 185 | 240 |
| Comp. Ex. 15 | (58) | 6.29 | 3.48 | 1.81 | 0.93 | 160 | 240 |
| Comp. Ex. 16 | (59) | 7.09 | 4.46 | 1.59 | 0.95 | 145 | 235 |

TABLE 6

| | Charge quantity (-μC/g) | | | Background fouling | | |
|---|---|---|---|---|---|---|
| | Start | 10K | End (100K) | Start | 10K | End (100K) |
| Ex. 14 | 30.4 | 32.7 | 33.2 | 0.01 | 0.02 | 0.02 |
| Ex. 15 | 31.6 | 33.6 | 34.7 | 0.01 | 0.01 | 0.02 |
| Ex. 16 | 29.9 | 30.1 | 29.6 | 0.02 | 0.02 | 0.02 |
| Ex. 17 | 31.1 | 32.0 | 32.1 | 0.01 | 0.01 | 0.02 |
| Ex. 18 | 31.6 | 32.7 | 32.4 | 0.01 | 0.02 | 0.02 |
| Ex. 19 | 32.2 | 32.5 | 33.1 | 0.01 | 0.01 | 0.01 |
| Ex. 20 | 31.0 | 31.5 | 31.9 | 0.02 | 0.02 | 0.02 |
| Ex. 21 | 33.0 | 32.5 | 32.8 | 0.01 | 0.01 | 0.02 |
| Ex. 22 | 28.4 | 26.3 | 27.0 | 0.02 | 0.03 | 0.04 |
| Ex. 23 | 26.6 | 26.3 | 26.7 | 0.02 | 0.03 | 0.03 |
| Ex. 24 | 27.9 | 28.2 | 28.4 | 0.02 | 0.04 | 0.04 |
| Ex. 25 | 27.7 | 27.3 | 27.0 | 0.03 | 0.03 | 0.03 |
| Ex. 26 | 29.4 | 30.1 | 30.7 | 0.01 | 0.02 | 0.03 |
| Ex. 27 | 30.9 | 31.2 | 32.3 | 0.01 | 0.02 | 0.02 |
| Ex. 28 | 28.8 | 29.4 | 29.6 | 0.02 | 0.02 | 0.03 |
| Ex. 29 | 29.9 | 30.8 | 31.1 | 0.01 | 0.02 | 0.02 |
| Ex. 30 | 30.2 | 29.5 | 29.4 | 0.02 | 0.02 | 0.02 |
| Ex. 31 | 31.8 | 32.0 | 31.5 | 0.01 | 0.02 | 0.02 |
| Ex. 32 | 28.7 | 29.1 | 28.3 | 0.02 | 0.02 | 0.04 |
| Ex. 33 | 30.6 | 30.9 | 30.8 | 0.01 | 0.02 | 0.02 |
| Ex. 34 | 30.1 | 30.6 | 31.0 | 0.01 | 0.02 | 0.02 |
| Ex. 35 | 31.6 | 32.2 | 33.2 | 0.01 | 0.01 | 0.01 |
| Ex. 36 | 29.3 | 29.9 | 28.5 | 0.01 | 0.02 | 0.03 |
| Ex. 37 | 30.4 | 30.7 | 29.8 | 0.01 | 0.01 | 0.02 |
| Comp. Ex. 12 | 30.6 | — | — | 0.03 | — | — |
| Comp. Ex. 13 | 28.3 | 16.4 | — | 0.02 | 0.39 | — |
| Comp. Ex. 14 | 37.2 | 42.3 | — | 0.02 | 0.18 | — |
| Comp. Ex. 15 | 32.4 | 24.6 | — | 0.03 | 0.24 | — |
| Comp. Ex. 16 | 29.6 | 20.9 | — | 0.03 | 0.30 | — |

| | Image density | | | Cleanability | | | Filming |
|---|---|---|---|---|---|---|---|
| | Start | 10K | End (100K) | Start | 10K | End (100K) | End (100K) |
| Ex. 14 | 1.42 | 1.43 | 1.47 | ○ | ○ | ○ | ○ |
| Ex. 15 | 1.45 | 1.48 | 1.51 | ○ | ○ | ○ | ○ |
| Ex. 16 | 1.43 | 1.41 | 1.45 | ○ | ○ | ○ | ○ |
| Ex. 17 | 1.44 | 1.47 | 1.47 | ○ | ○ | ○ | ○ |
| Ex. 18 | 1.43 | 1.42 | 1.45 | ○ | ○ | ○ | ○ |
| Ex. 19 | 1.45 | 1.47 | 1.48 | ○ | ○ | ○ | ○ |
| Ex. 20 | 1.41 | 1.42 | 1.42 | ○ | ○ | ○ | ○ |
| Ex. 21 | 1.46 | 1.49 | 1.47 | ○ | ○ | ○ | ○ |
| Ex. 22 | 1.39 | 1.41 | 1.38 | ○ | ○ | ○ | ○ |
| Ex. 23 | 1.43 | 1.42 | 1.41 | ○ | ○ | ○ | ○ |

TABLE 6-continued

| | | | | | | | |
|---|---|---|---|---|---|---|---|
| Ex. 24 | 1.40 | 1.42 | 1.38 | ○ | ○ | ○ | ○ |
| Ex. 25 | 1.42 | 1.44 | 1.43 | ○ | ○ | ○ | ○ |
| Ex. 26 | 1.42 | 1.41 | 1.39 | ○ | ○ | ○ | ○ |
| Ex. 27 | 1.43 | 1.46 | 1.48 | ○ | ○ | ○ | ○ |
| Ex. 28 | 1.43 | 1.40 | 1.39 | ○ | ○ | ○ | ○ |
| Ex. 29 | 1.44 | 1.42 | 1.45 | ○ | ○ | ○ | ○ |
| Ex. 30 | 1.49 | 1.47 | 1.50 | ○ | ○ | ○ | ○ |
| Ex. 31 | 1.50 | 1.51 | 1.54 | ○ | ○ | ○ | ○ |
| Ex. 32 | 1.49 | 1.52 | 1.51 | ○ | ○ | ○ | ○ |
| Ex. 33 | 1.51 | 1.50 | 1.53 | ○ | ○ | ○ | ○ |
| Ex. 34 | 1.41 | 1.42 | 1.40 | ○ | ○ | ○ | ○ |
| Ex. 35 | 1.42 | 1.43 | 1.42 | ○ | ○ | ○ | ○ |
| Ex. 36 | 1.40 | 1.41 | 1.41 | ○ | ○ | ○ | ○ |
| Ex. 37 | 1.44 | 1.42 | 1.42 | ○ | ○ | ○ | ○ |
| Comp. Ex. 12 | 1.29 | — | — | X | — | — | — |
| Comp. Ex. 13 | 1.40 | 1.43 | — | ○ | ○ | — | — |
| Comp. Ex. 14 | 1.50 | 0.63 | — | ○ | — | — | — |
| Comp. Ex. 15 | 1.43 | 0.92 | — | ○ | X | — | — |
| Comp. Ex. 16 | 1.45 | 1.00 | — | ○ | X | — | — |

Note:

1) The toner 55 prepared in Comparative Example 12 had so bad cleanability that the running test could not be performed.
2) The toner 56 prepared in Comparative Example 13 had slightly bad fixability, and caused a problem in that the resultant images had serious background fouling due to deterioration of charging property of the toner when 10,000 images were produced. Therefore, the running test was suspended.
3) The toner 57 prepared in Comparative Example 14 caused problems in that the resultant images were badly fixed and the resultant images had serious background fouling due to deterioration of charging property of the toner when 10,000 images were produced. Therefore, the running test was suspended.
4) The toners 58 and 59 prepared in Comparative Examples 15 and 16 caused problems in that cleaning was not well performed and the resultant images had serious background fouling due to deterioration of charging property of the toner when 10,000 images were produced. Therefore, the running test was suspended.

This document claims priority and contains subject matter related to Japanese Patent Applications Nos. 2002-365782, 2002-333251 and 2002-281900, filed on Dec. 17, 2002, Nov. 18, 2002 and Sep. 26, 2002, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A method for manufacturing a toner comprising toner particles, comprising:

dissolving or dispersing a toner composition, comprising (i) at least a polyester prepolymer (A) having an isocyanate group, and being capable of reacting with an active hydrogen;

(ii) an amine (B) as a compound having an active hydrogen, (iii) a second resin having a weight average molecular weight of from 2,000 to 10,000, (iv) a colorant, and (v) a release agent, in an organic solvent, to obtain an oil phase liquid;

dispersing the oil phase liquid in an aqueous medium comprising a particulate material while subjecting the polyester prepolymer (A) to an addition polymerization reaction using said compound having said active hydrogen as a cross-linking agent, extending agent or both, to prepare a urea-modified polyester resin and to prepare a dispersion;

removing at least the organic solvent from the dispersion to prepare the toner particles comprising a binder resin which comprises said urea-modified polyester resin and said second resin having a weight average molecular weight of from 2,000 to 10,000;

washing the toner particles; and drying the toner particles;

wherein said particulate material comprises a particulate resin which is crosslinked;

wherein said binder resin has a glass transition temperature of from 35° C. to below 55° C.;

wherein the particulate material is embedded into the surface of the toner particles;

wherein the particulate material has an average particle diameter of from 0.002 to 0.2 times that of the toner particles.

2. The method according to claim 1, wherein the particulate material comprises a particulate resin having a glass transition temperature of from 55 to 100° C.

3. The method according to claim 2, wherein the particulate resin includes a resin selected from the group consisting of vinyl resins, polyurethane resins, epoxy resins and polyester resins.

4. The method according to claim 1, wherein said binder resin comprises said urea-modified polyester resin and said second resin;

and wherein the binder resin includes tetrahydrofuran-insoluble components in an amount of from 2 to 30% by weight.

5. The method according to claim 1, wherein the second resin is an unmodified polyester resin, and wherein a ratio of the urea-modified polyester resin to the unmodified polyester resin is from 5/95 to 60/40.

6. The method according to claim 1, wherein the toner particles have a spindle form.

7. The method according to claim 6, wherein a ratio (r2/r1) of a minor axis particle diameter (r2) of the toner particles to a major axis particle diameter (r1) of the toner particles is from 0.5 to 0.8, and a ratio (r3/r2) of a thickness (r3) of the toner particles to the minor axis particle diameter (r2) is from 0.7 to 1.0.

8. The method according to claim 1, wherein the binder resin comprises tetrahydrofuran-insoluble components in an amount of from 1 to 30% by weight based on total weight of the binder resin.

9. The method according to claim 1, wherein the release agent is a wax.

10. The method according to claim 1, further comprising adding an external additive to said toner particles so that said external additive is present at least on a surface of the toner particles.

* * * * *